US009436152B2

(12) United States Patent
Honjoh et al.

(10) Patent No.: US 9,436,152 B2
(45) **Date of Patent: *Sep. 6, 2016**

(54) LUBRICANT SUPPLYING DEVICE, IMAGE FORMING APPARATUS AND PROCESS CARTRIDGE

(71) Applicant: RICOH COMPANY, LTD., Tokyo (JP)

(72) Inventors: Kenji Honjoh, Kanagawa (JP); Takeshi Shintani, Kanagawa (JP); Kohsuke Yamamoto, Kanagawa (JP); Daisuke Tomita, Kanagawa (JP); Norio Kudo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/836,105

(22) Filed: Aug. 26, 2015

(65) Prior Publication Data

US 2015/0370218 A1 Dec. 24, 2015

Related U.S. Application Data

(63) Continuation of application No. 13/845,971, filed on Mar. 18, 2013, now Pat. No. 9,146,517.

(30) Foreign Application Priority Data

Mar. 21, 2012 (JP) ..... 2012-063690
Oct. 1, 2012 (JP) ..... 2012-219731

(51) Int. Cl.
*G03G 21/00* (2006.01)
*G03G 15/00* (2006.01)

(52) U.S. Cl.
CPC ..... *G03G 21/0094* (2013.01); *G03G 15/553* (2013.01)

(58) Field of Classification Search
CPC ..... G03G 15/553; G03G 21/007
USPC ..... 399/346, 349, 25, 24
See application file for complete search history.

(56) References Cited

U.S. PATENT DOCUMENTS 5,643,127 A * 7/1997 Yoshii ..... F16H 57/043 184/6.12
7,260,982 B2 * 8/2007 Utz ..... F01M 11/10 73/114.55

(Continued)

FOREIGN PATENT DOCUMENTS

JP 7-311531 A 11/1995
JP 08-314346 11/1996

(Continued)

OTHER PUBLICATIONS

Kojima, Oil Amount Detector of Tranmission, Oct. 9, 1998, JP 10-267113, Machine English Translation of Claims from JPO.

(Continued)

*Primary Examiner* — Susan Lee
(74) *Attorney, Agent, or Firm* — Oblon, McClelland, Maier & Neustadt, L.L.P.

(57) ABSTRACT

A lubricant supplying device used with a solid lubricant, includes a supplying member to supply lubricant taken from the solid lubricant to an object to be supplied with the lubricant, and a remaining amount detecting section to detect a remaining amount of the solid lubricant becoming below a predetermined value. A detection of the remaining amount of the solid lubricant is executed when an operation to supply the lubricant to the object to be supplied with the lubricant stops.

20 Claims, 15 Drawing Sheets

(56) References Cited

U.S. PATENT DOCUMENTS

| | | | | |
|---|---|---|---|---|
| 7,899,383 | B2 | 3/2011 | Shintani et al. | |
| 7,953,363 | B2 | 5/2011 | Honjoh et al. | |
| 8,380,115 | B2 | 2/2013 | Shintani et al. | |
| 9,081,347 | B2 | 7/2015 | Fujimori et al. | |
| 2002/0174705 | A1* | 11/2002 | Berndorfer | G01N 33/2888 73/1.02 |
| 2011/0227942 | A1* | 9/2011 | Fujimoto | B60K 35/00 345/619 |
| 2011/0229232 | A1 | 9/2011 | Kojima et al. | |
| 2012/0141297 | A1* | 6/2012 | Jeong | B60K 6/48 417/5 |
| 2012/0315053 | A1 | 12/2012 | Kudo et al. | |
| 2012/0321330 | A1 | 12/2012 | Kudo et al. | |

FOREIGN PATENT DOCUMENTS

| | | | |
|---|---|---|---|
| JP | 08305236 | A * | 11/1996 |
| JP | 10267113 | A * | 10/1998 |
| JP | 2007225847 | A | 9/2007 |
| JP | 2009-9036 | A | 1/2009 |
| JP | 2010-271665 | | 12/2010 |
| JP | 2011-197126 | | 10/2011 |

OTHER PUBLICATIONS

Office Action issued Oct. 9, 2015 in Japanese Patent Application No. 2012-219731.

* cited by examiner

LUBRICANT SUPPLYING DEVICE, IMAGE FORMING APPARATUS AND PROCESS CARTRIDGE

CROSS REFERENCE TO RELATED APPLICATIONS

This application is a continuation of U.S. application Ser. No. 13/845,971, filed Mar. 18, 2013, which claims the benefit of priority from Japanese Patent Application No. 2012-219731, filed Oct. 1, 2012, and Japanese Patent Application No. 2012-063690, filed Mar. 21, 2012, the contents of which is incorporated in its entirety.

BACKGROUND OF THE INVENTION

1. Field of the Invention

The disclosures herein generally relate to a lubricant supplying device, an image forming apparatus and a process cartridge.

2. Description of the Related Art

It is known that there are image forming apparatuses such as printers, facsimile machines, copying machines, etc., provided with a lubricant supplying device to supply lubricant to a surface of a photoreceptor or an image bearing body, such as an intermediate transfer belt, to protect the image bearing member or to reduce friction.

The lubricant supplying device provides a supplying member making contact with a bar-shaped solid lubricant to be rubbed and scraped off by the supplying member, for generating fine-powder lubricant to be supplied to the image bearing member. The lubricant supplying device also provides a lubricant holding member at the opposing end to the contacting end with the supplying member. The lubricant holding member is held in a case of the lubricant supplying device, and movable in a direction moving toward/away from the solid lubricant. Also, in the opposing space in the case to the side holding the solid lubricant of the lubricant holding member, a pressure applying mechanism is provided to apply pressure to the end of the lubricant holding member holding the solid lubricant toward the supplying member.

When the supplying member rotates, the supplying member rubs the solid lubricant contacting with it, scrapes off lubricant to be transferred to the supplying member, which is then applied to the surface of the image bearing member. While the solid lubricant is scraped off gradually by being rubbed by the supplying member, the lubricant holding member moves toward the supplying member. With this movement, the solid lubricant makes contact with the supplying member from the beginning to the end of its usage so that the supplying member can scrape off the solid lubricant well.

If an image forming operation is executed after the lubricant has been completely consumed, the image bearing member wears out due to deterioration because the image bearing member is not protected with the lubricant. Japanese Laid-open Patent Application No. 2010-271665 (referred to as Patent document 1, hereafter), and Japanese Laid-open Patent Application No. 2011-197126 (referred to as Patent document 2, hereafter) disclose a lubricant supplying device providing a remaining amount detecting section to indicate when the remaining amount of a solid lubricant becomes only a small amount, which is detected by the length of the solid lubricant in the moving direction (called the height of the solid lubricant, hereafter) becomes less than a prescribed value when being scraped off.

In the lubricant supplying device described in Patent documents 1 and 2, the lubricant holding member is configured with a conductive member with which an electrode member comes into contact. The remaining amount detecting section described in Patent document 1 or the sixth modified example in Patent document 2 is in a conductive state in which the conductive member and the lubricant holding member contact each other at the beginning of the usage of the lubricant. When the height of the solid lubricant is reduced and the remaining amount of the solid lubricant becomes only a small amount, the conductive member and the lubricant holding member are separated to be in a non-conductive state. The transition from the conductive state to the non-conductive state makes it possible to detect when the remaining amount of the solid lubricant becomes only a small amount.

In the remaining amount detecting section described in the fifth modified example in Patent document 2, on the contrary to the above, at the beginning of the usage of the lubricant, the conductive member and the lubricant holding member are separated to be in a non-conductive state. When the height of the solid lubricant is reduced to less than a prescribed value, the conductive member and the lubricant holding member come into contact with each other to be in a conductive state. The transition from the non-conductive state to the conductive state makes it possible to detect when the remaining amount of the solid lubricant becomes only a small amount.

However, in the remaining amount detecting section described in Patent document 1 or 2 which monitors whether the height of the solid lubricant is reduced to less than a prescribed value to detect whether the remaining amount of the solid lubricant becomes only a small amount, there is a problem of a false detection of the remaining amount of the lubricant. The inventors of the present invention have researched this issue intensively to identify the cause of the false detection. It turns out that the false detection may happen if the detection of the remaining amount is executed while the lubricant is being supplied to a target object of lubrication. The reason is as follows. While the lubricant is being supplied to a target object of lubrication, the solid lubricant is vibrating in the height direction of the solid lubricant because the supplying member rubs the solid lubricant. The vibration makes the position of the lubricant holding member fluctuate in the height direction of the solid lubricant. As a result, the contact between the lubricant holding member and the electrode member becomes unstable to cause a false detection in which the transition to a conductive state does not happen even if the remaining amount of the lubricant becomes less than the prescribed value, which is falsely recognized that the remaining amount of the lubricant being more than the prescribed value; or another false detection in which a conductive state remains unchanged even if the remaining amount of the lubricant becomes less than the prescribed value, which is falsely recognized as the remaining amount of the lubricant being more than the prescribed value.

As above, the problem of the false detection is described with the remaining amount detecting section to detect electrical continuity between the electrode member and the lubricant holding member. A similar problem may occur with other types of remaining amount detecting sections. For example, in the lubricant applying device providing a remaining amount detecting section to indicate when the remaining amount of the lubricant becomes near-end by pushing a switch, a similar problem may occur.

SUMMARY OF THE INVENTION

It is a general object of at least one embodiment of the present invention to provide a lubricant supplying device, an image forming apparatus, and a process cartridge with which a false detection of the remaining amount of the lubricant caused by the vibration of the solid lubricant can be avoided.

According to at least one embodiment of the present invention, a lubricant supplying device used with a solid lubricant, includes a supplying member to supply lubricant taken from the solid lubricant to an object to be supplied with the lubricant, and a remaining amount detecting section to detect a remaining amount of the solid lubricant becoming below a predetermined value. A detection of the remaining amount of the solid lubricant is executed when an operation to supply the lubricant to the object to be supplied with the lubricant stops.

According to at least one embodiment of the present invention, by detecting the remaining amount during a lubricant supplying operation to a target object of lubrication being stopped, it is possible to detect the length of the solid lubricant becoming shorter than the prescribed value in the moving direction while the solid lubricant is not vibrating. In this way, it is possible to detect when the remaining amount of the lubricant becomes less than the prescribed value precisely.

BRIEF DESCRIPTION OF THE DRAWINGS

Other objects and further features of embodiments will become apparent from the following detailed description when read in conjunction with the accompanying drawings.

DESCRIPTION OF THE PREFERRED EMBODIMENTS

Figure 1:
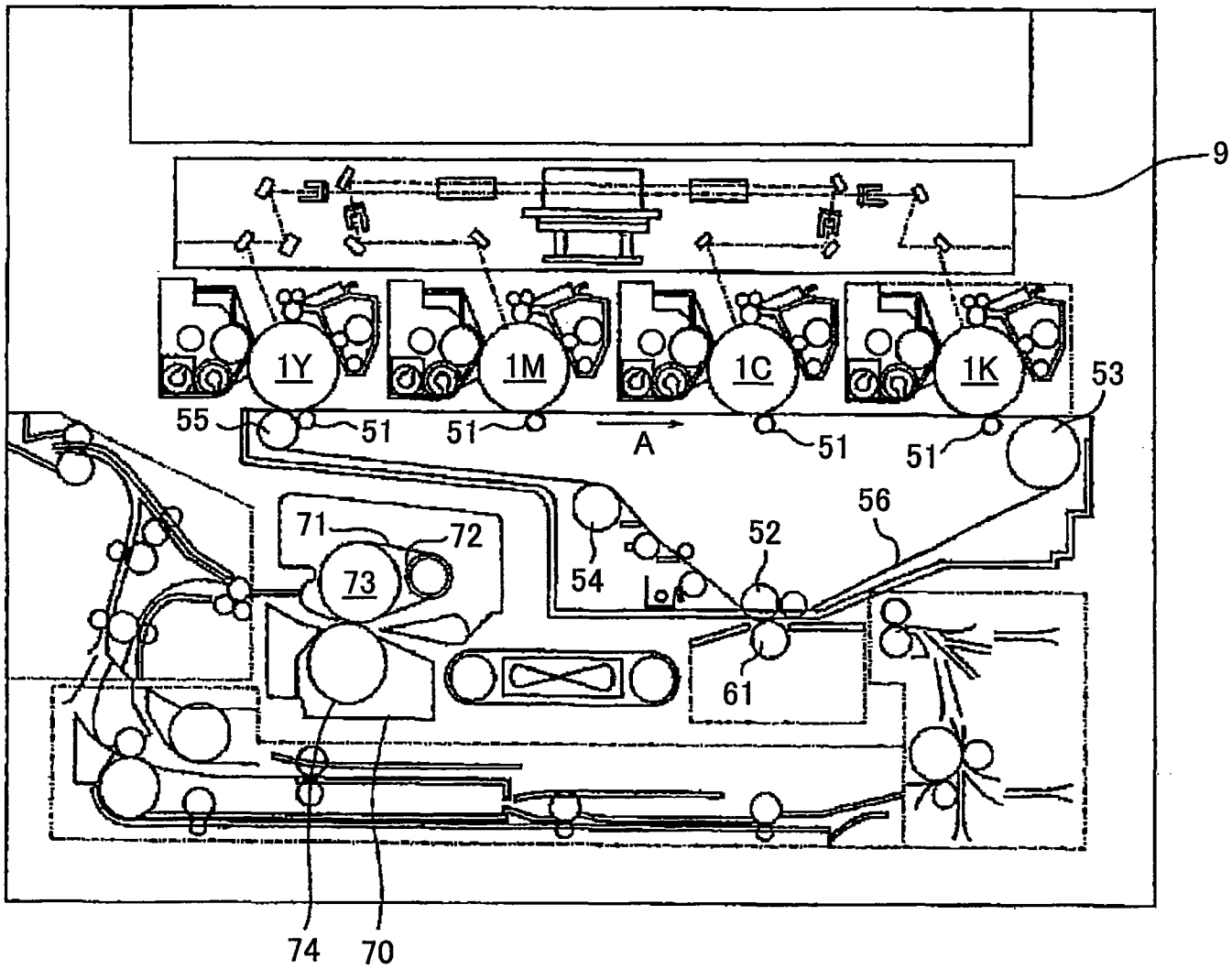
FIG. 1 is a general configuration diagram of a printer according to the first embodiment of the present invention.

In the following, an embodiment of the present invention will be described, which is applied to a printer as an electrophotographic image forming apparatus. FIG. 1 is a general configuration diagram of the printer according to the present embodiment. The printer has an intermediate transfer belt 56 as an intermediate transfer body as an image bearing member about the center of its inside. The intermediate transfer belt 56 is made of a heat-resistant material such as polyimide or polyamide. The intermediate transfer belt 56 is an endless belt made of a base material adjusted to have a middle resistance, which is wrapped and stretched around four rollers 52, 53, 54, and 55 to be driven rotationally in the direction designated by an arrow A in FIG. 1. Over the intermediate transfer belt 56, four image creating units, which correspond to color toners for yellow (Y), magenta (M), cyan (C), and black (K), are arranged along the belt surface of the intermediate transfer belt 56.

Figure 2:
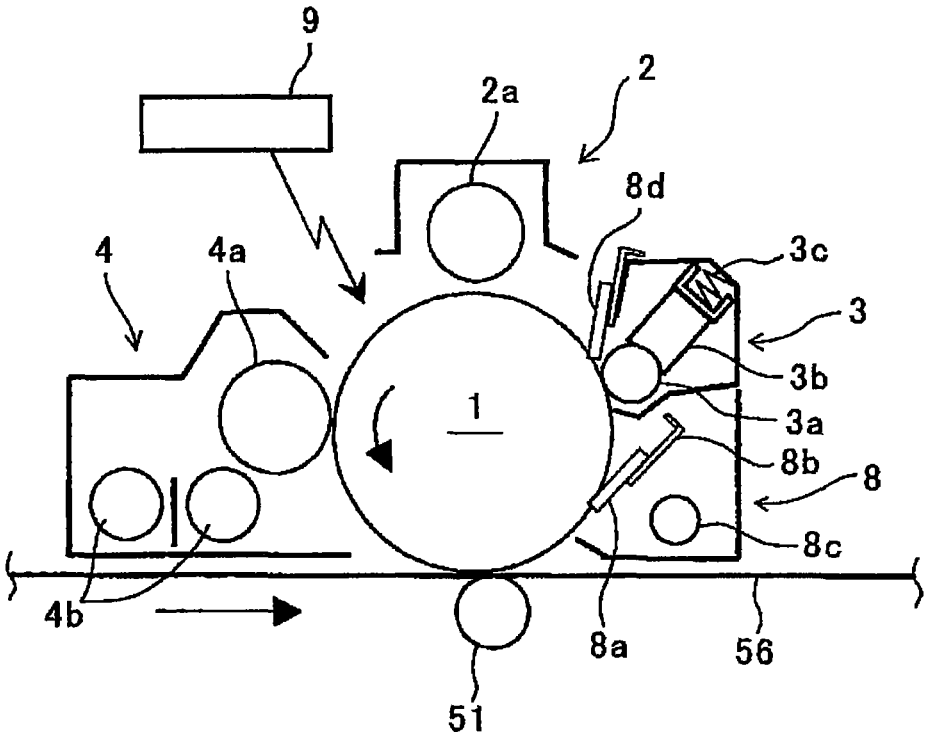
FIG. 2 is an enlarged view of one of four image creating units.

FIG. 2 is an enlarged view of one of the four image creating units. Since the image creating units have the same configuration, here, the subscript showing color distinctions, such as Y, M, C, or K will be omitted. Each of the image creating units has a photoreceptor drum 1. Around the photoreceptor drum 1, there are a charging device 2 for charging the surface of the photoreceptor drum 1 with a predetermined voltage (negative polarity), a developing device 4 for making a toner image by developing an electrostatic latent image created on the surface of the photoreceptor drum 1 with the color toners charged with negative polarity, a lubricant applying device 3, and a cleaning device 8 for cleaning the surface of the photoreceptor drum 1 after the toner has been transferred.

Each of the image creating units is configured as a process cartridge attachable/detachable with the image forming apparatus, in which the photoreceptor drum 1, the charging device 2, the developing device 4, the cleaning device 8 and the lubricant applying device 3 are included to be exchangeable as a whole.

Referring to FIG. 1, an exposure device 9 is disposed over the four image creating units, which writes an electrostatic latent image on the surface of each of the photoreceptor drums 1 by exposing the surface to light based on image data for the respective color. Also, at a position opposite to each of the photoreceptor drums 1 across the intermediate transfer belt 56, a first transfer roller 51 is disposed for the first transfer of the toner image created on the photoreceptor drum 1 onto the intermediate transfer belt 56. The first transfer roller 51 is connected with a power source (not shown) from which a predetermined voltage is applied.

The intermediate transfer belt 56 is also supported by the roller 52, to which a second transfer roller 61 for the second transfer is pressed from the outside surface of the intermediate transfer belt 56 having the intermediate transfer belt 56 nipped in-between. The second transfer roller 61 is also connected with a power source (not shown) from which a predetermined voltage is applied. The contact point between the second transfer roller 61 and the intermediate transfer belt 56 is a position where the second transfer is executed, namely, the toner image on the intermediate transfer belt 56 is transferred to a recording sheet as a recording medium.

The photoreceptor drum 1 is an organic photoreceptor whose surface is protected with a layer made of a polycarbonate resin. The charging device 2 includes a charging roller 2*a* which has a conductive metal in its inside covered by an elastic layer with an intermediate resistance. The charging roller 2*a* is also connected with a power source (not shown) from which a predetermined voltage is applied. The charging roller 2*a* is disposed having a thin gap with the photoreceptor drum 1. The thin gap is set by having a spacer member with a certain thickness rolled around both ends of the charging roller 2*a* out of the image forming region.

The developing device 4 includes a developing sleeve 4*a* disposed at a position opposite to the photoreceptor drum 1, which bears a developer and has a magnetic field generator in its inside. Two screws 4*b* are disposed below the developing sleeve 4*a* to mix the toner coming from a toner bottle (not shown) with the developer, which is drawn up to the developing sleeve 4*a* while being churned. The mixed developer including magnetic carriers and toner is then drawn up by the developing sleeve 4*a*, leveled out by a doctor blade (not shown) to be borne as a layer with a predetermined thickness on the developing sleeve 4*a*. The developing sleeve 4*a* bears and conveys the developer to supply the toner onto an electrostatic latent image on the photoreceptor drum 1 at the position opposite to the photoreceptor drum 1 while moving in the same linear direction with the photoreceptor drum 1. In FIG. 1, the developing device 4 adopting two-component development is shown. Alternatively, the developing device 4 may adopt single-component development.

The lubricant applying device 3 includes a solid lubricant 3*b* held in a fixed case and an applying roller 3*a* for applying powder lubricant, which is scraped off from the solid lubricant 3*b*, on the surface of the photoreceptor drum 1. A brush roller or a urethane foam roller may be used as the applying roller 3*a*. If a brush roller is used as the applying roller 3*a*, it is preferable to use a brush roller made of nylon or acrylic resin or the like with a resistance controlling material added such as carbon black to have a volume resistivity in a range between $1\times10^3$ Ωcm to $1\times10^8$ Ωcm. The applying roller 3*a* rotates in a same direction as the direction in which the photoreceptor drum 1 rotates. Namely, at the contact point between the photoreceptor drum 1 and the applying roller 3*a*, the surface of the applying roller 3*a* moves in the reverse direction to the direction in which the surface of the photoreceptor drum 1 moves. Alternatively, the surface of the applying roller 3*a* may move in the reverse direction as the surface of the photoreceptor drum 1 moves.

The solid lubricant 3*b* is formed in a rectangular shape, which is pressed by a pressure applying mechanism 3*c* (described later) in the direction toward the applying roller 3*a*. The solid lubricant 3*b* is a lubricant including at least a fatty acid metal salt. As a fatty acid metal salt, for example, the following materials may be used: a fluorocarbon resin, a fatty acid metal salt with a lamella crystal structure such as zinc stearate, calcium stearate, barium stearate, aluminum stearate, and magnesium stearate; lauroyl lysine, zinc sodium monoacetyl phosphate, lauroyl taurine calcium, or the like. Among fatty acid metal salts, it is particularly preferable to use zinc stearate because zinc stearate has very good extensibility on the surface of the photoreceptor drum 1, low moisture absorbency, and lubricity unlikely to change with temperature. Therefore, zinc stearate can form a protection layer of lubricant film less likely to be affected by environmental changes and highly capable of protecting the surface of the photoreceptor drum 1. Having the lubricity unlikely to change with temperature, zinc stearate is also effective to reduce cleaning defects. Other than these fatty acid metal salts, liquid or gasified materials may be added as external additives, such as silicone oil, fluorine-based oil, natural wax, or the like.

It is preferable that a lubricant for the solid lubricant 3*b* includes boron nitride which is an inorganic lubricant. Crystal structures of boron nitride include a hexagonal low-pressure phase (h-BN) structure, a cubic high-pressure phase structure, etc. Among these crystal structures of boron nitride, crystal of the hexagonal low-pressure phase has a layered structure, which is a material easily cleaved. Therefore, it is capable of maintaining the coefficient of friction below 0.2 up to 40° C. It is also less likely to change its characteristics by an electric discharge, and less likely to lose lubricity by an electric discharge. By adding such boron nitride, thin-filmed lubricant supplied on the surface of the photoreceptor drum 1 may not be deteriorated soon by an electric discharge generated when the charging device 2 or the first transfer roller 51 is operating. In addition, boron nitride can protect the photoreceptor layer of the photoreceptor drum 1 from oxidation or evaporation which might be caused by electric discharges. Moreover, since boron nitride can show its lubricity with adding just a tiny amount of it, it is effective to protect defects that might be caused by adhesion of lubricant to the charging roller 2*a* or the like, or a blade noise at a cleaning blade 8*a*.

In the present embodiment, the solid lubricant 3*b* is made of a lubricant material including zinc stearate and boron nitride by compression molding. A method for molding the solid lubricant 3*b* is not limited to compression molding, but other methods such as melt molding may be used. With the solid lubricant 3*b* formed as above, effects of zinc stearate and boron nitride can be realized.

Although the solid lubricant 3*b* has its thickness reduced gradually while being scraped off by the applying roller 3*a*, it always makes contact with the applying roller 3*a* because pressure is applied to the solid lubricant 3*b* by the pressure applying mechanism 3*c*. The applying roller 3*a* rotates and scrapes off the lubricant to apply the lubricant on the surface of the photoreceptor drum 1. After that, by contact between the surface of the photoreceptor drum 1 and the cleaning blade 8*a*, applied lubricant is extended to form a thin film. Having the thin film formed, the coefficient of friction on the surface of the photoreceptor drum 1 is reduced. Here, the lubricant film applied to the surface of the photoreceptor drum 1 is so thin that the film does not hinder charging by the charging roller 2*a*.

The cleaning device 8 includes the cleaning blade 8*a* as a cleaning member, a support member 8*b*, and a toner recovering coil 8*c*. The cleaning blade 8*a* is made of rubber such as urethane rubber or silicone rubber, formed into a plate whose edge is to be attached to the surface of the photoreceptor drum 1, which removes the remaining toner on the surface of the photoreceptor drum 1 after transfer. The cleaning blade 8*a* is attached to the support member 8*b*, which is made of metal, plastic, ceramics, or the like, to be supported by the support member 8*b*, and is disposed with a predetermined angle to the surface of the photoreceptor drum 1. Here, as a cleaning member, instead of the cleaning blade 8*a*, a cleaning brush or any other known member may be used.

In the present embodiment, the lubricant applying device 3 is disposed at a downstream position relative to the cleaning device 8. The lubricant applied to the surface of the photoreceptor drum 1 by the lubricant applying device 3 is then wiped by a cleaning device 8*d* to be extended and leveled, which reduces thickness variation of the lubricant appearing soon after having been applied on the surface of the photoreceptor drum 1.

Figure 3B:
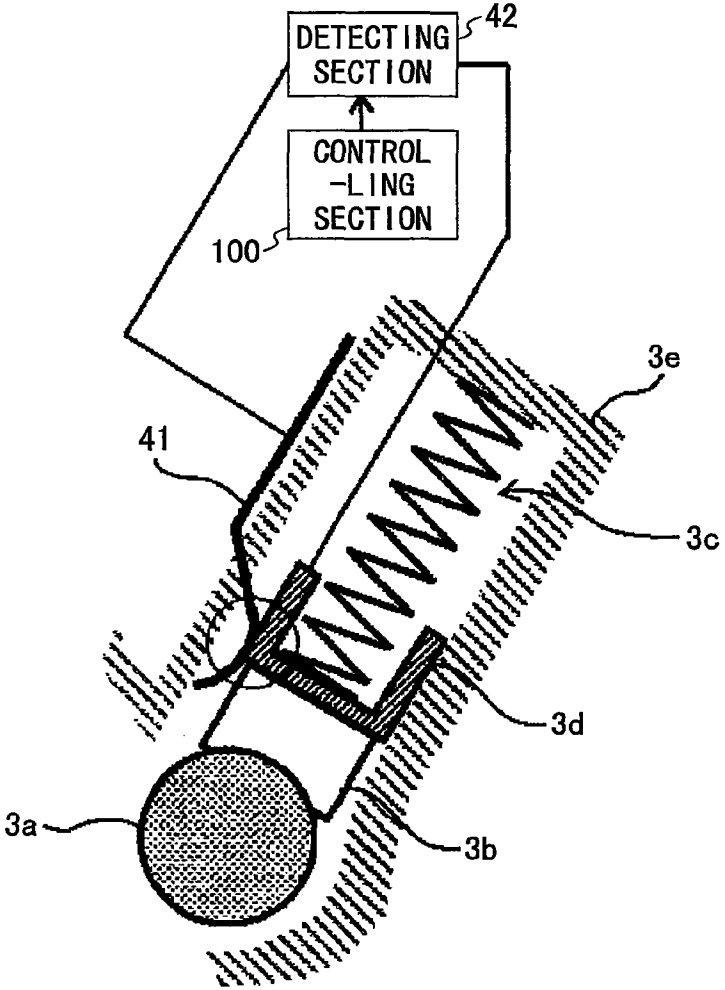
FIG. 3B is another general configuration diagram of the lubricant applying device with the solid lubricant in its near-end stage of usage.
Figure 3A:
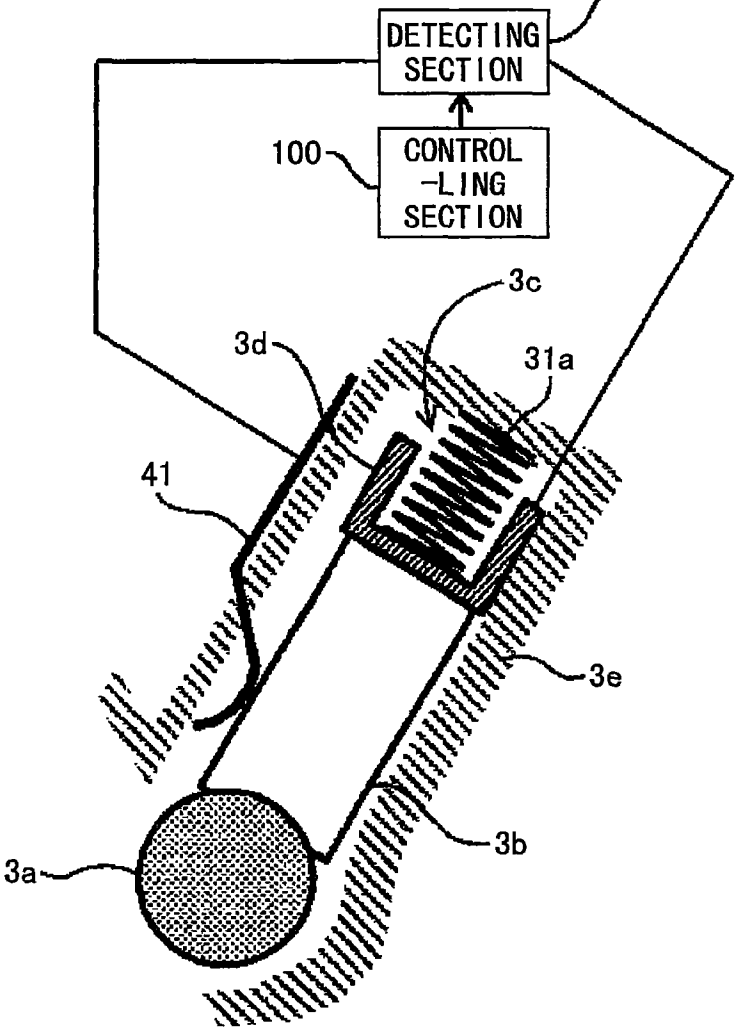
FIG. 3A is a general configuration diagram of a lubricant applying device with a solid lubricant in its early stage of usage.

The lubricant applying device 3 will be described in detail. FIGS. 3A-3B are general configuration diagrams of the lubricant applying device 3. FIG. 3A shows the solid lubricant 3*b* in its early stage of the usage, whereas FIG. 3B shows that the remaining amount of the solid lubricant 3*b* is only a small amount (near-end state). As shown in FIG. 3A, a lubricant support member 3*d* is disposed at the surface of the solid lubricant 3*b* opposing the surface of the solid lubricant 3*b* contacting the applying roller 3*a* (the lower surface in FIG. 3A) so that the surface of the lubricant support member 3*d* makes contact with the solid lubricant 3*b* to support the solid lubricant 3*b* in the longitudinal direction, which is the near-vertical direction to this two-dimensional FIG. 3A. The lubricant support member 3*d* is disposed in a housing case 3*e* to be able to move close to or away from the applying roller 3*a*. In addition, the pressure applying mechanism 3*c* is provided in a space above the lubricant support member 3*d* in the housing case 3*e* to apply pressure on the lubricant support member 3*d* to push the lubricant support member 3*d* toward the applying roller 3*a*.

The pressure applying mechanism 3*c* has a pressure applying spring 31*a*, with which the lubricant support member 3*d* is pushed toward the applying roller 3*a*.

Also, electrode members 41 are provided at both ends in the longitudinal direction of the solid lubricant 3*b*, one of which is shown in FIG. 3A. The lubricant support member 3*d* is formed of a conductive material, and the lubricant support member 3*d* and the electrode member 41 are connected with a detecting section 42. The detecting section 42 is connected with a controlling section 100 that controls the detecting section 42. The detecting section 42 measures electrical resistance by applying a voltage between the electrode member 41 and the lubricant support member 3*d*.

As shown in FIG. 3A, at the beginning of the solid lubricant 3*b* usage, the lubricant support member 3*d* is separated from the electrode member 41 to be in a non-conductive state. Therefore, the detecting section 42 cannot measure electrical resistance at this moment because a current cannot flow between the electrode member 41 and the lubricant support member 3*d* even if a voltage is applied between the electrode member 41 and the lubricant support member 3*d*.

When the solid lubricant 3*b* is scraped off and consumed to reduce its height, the lubricant support member 3*d* approaches the applying roller 3*a*. When the remaining amount of the lubricant becomes only a small amount (near-end state) as shown in FIG. 3B, the lubricant support member 3*d* comes into contact with the electrode member 41. Once the lubricant support member 3*d* comes into contact with the electrode member 41, the state of the lubricant support member 3*d* and the electrode member 41 transitions from the non-conductive state to a conductive state. With the state transition, the detecting section 42 can now measure electrical resistance by applying a voltage between the lubricant support member 3*d* and the electrode member 41 to flow the current between the lubricant support member 3*d* and the electrode member 41.

The controlling section 100 monitors the measurement result by the detecting section 42 to determine the near-end state of the solid lubricant 3*b* if the electrical resistance detected by the detecting section 42 is below a predetermined value. Upon a determination of the near-end state, the controlling section 100 indicates on an operation panel (not shown) that the remaining amount of the solid lubricant 3*b* becomes only a small amount to prompt a user to exchange the solid lubricant 3*b* with a new one. Alternatively, the controlling section 100 may indicate to a service center using a communication section (not shown) that an exchange of the solid lubricant 3*b* is necessary.

In the present embodiment, the lubricant support member 3*d* and the electrode member 41 are in a non-conductive state, in which a current does not flow if a voltage is applied between the electrodes, until the lubricant support member 3*d* moves to the position corresponding to the near-end state of the solid lubricant 3*b*. This prevents electric power from being consumed every time a detecting operation is executed to determine whether the near-end state has been reached, which reduces electric power consumption.

Also in the present embodiment, the electrode members 41 are disposed at both ends in the longitudinal direction of the solid lubricant 3*b*. Therefore, if the amounts of lubricant consumption are different at both ends, one of the electrode members 41 where more lubricant is consumed than the other first comes into contact with the lubricant support member 3*d* to be in a conductive state. This makes it possible to detect the near-end state of the solid lubricant 3*b* even if the amounts of lubricant consumption are different at both ends in the longitudinal direction of the solid lubricant 3*b*. This also makes it possible to prevent the surface of the photoreceptor drum 1 from being deteriorated which might be caused by lack of protection due to lack of the lubricant at the end of the solid lubricant 3*b* where more lubricant has been consumed.

Also in the present embodiment, the near-end state, in which the solid lubricant 3*b* can still supply the lubricant on the surface of the photoreceptor drum 1 for a certain amount, is detected instead of the end state in which the lubricant has been virtually completely consumed. If an image forming operation is executed after a detection of the end state of the solid lubricant 3*b*, a defect may be caused by the lack of the lubricant. To prevent the defect, an image forming operation needs to be stopped until the solid lubricant 3*b* is exchanged with a new one, which incurs a downtime.

On the other hand, in the present embodiment, by detecting the near-end state of the lubricant, it is possible to perform image forming operations for a certain number of times after the detection, with which the lubricant is applied on the surface of the photoreceptor drum 1 to protect the surface of the photoreceptor drum 1. Therefore, a downtime of image forming operations can be avoided while an exchange of the solid lubricant 3*b* is being prepared after the detection. However, if image forming operations are executed more than a certain number of times while the exchange of the solid lubricant 3*b* is being prepared, the lubricant may be completely consumed to cause a defect. Therefore, after a detection of a near-end state, the distance covered by the applying roller 3*a*, the number of image forming operations, and the like are monitored. If the distance covered by the applying roller 3*a* or the number of image forming operations exceeds a predetermined value, it is determined as the end state of the lubricant to stop an image forming operation.

In the above configuration, the remaining amount detection of the solid lubricant 3*b* is done by detecting an electrical continuity between the lubricant support member 3*d* made of a conductive material and the electrode member 41 disposed at the housing case 3*e*. Alternatively, other configurations may be adopted as long as the remaining amount can be detected with an electrical continuity between conductive members. For example, an electrode may be disposed at the lubricant support member 3*d* to detect an electrical continuity.

Figure 4A:
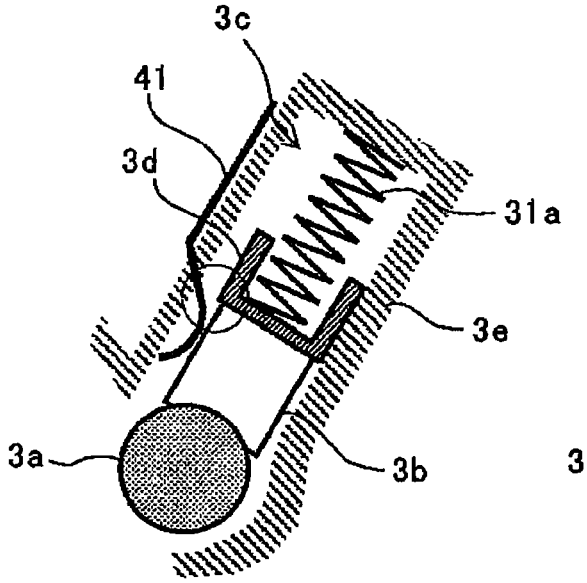
FIG. 4A is a schematic view illustrating a state of the lubricant applying device while a lubricant applying operation is stopped.
Figure 4B:
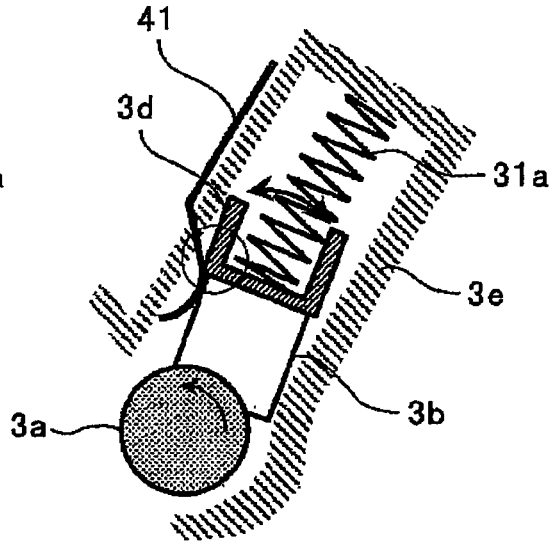
FIG. 4B is a schematic view illustrating a state of the lubricant applying device while a lubricant applying operation is being executed.

FIG. 4A is a schematic view illustrating a state of the lubricant applying device 3 when a lubricant applying operation stops. FIG. 4B is a schematic view illustrating a state of the lubricant applying device 3 when a lubricant applying operation is executed. As shown in FIG. 4A, when the lubricant application operation stops, the lubricant support member 3*d* is separated from the electrode member 41 to be in a non-conductive state.

On the other hand, as shown in FIG. 4B, when the lubricant application operation is executed, the applying roller 3*a* rotates to scrape off the solid lubricant 3*b*. Therefore, the solid lubricant 3*b* receives a force in a direction in which the surface of the applying roller 3*a* moves (leftward in FIG. 4B). The lubricant support member 3*d* is held in the housing case 3*e* with play because the lubricant support member 3*d* needs to be movable in the housing case 3*e*. Therefore, when the solid lubricant 3*b* receives a force in the direction in which the surface of the applying roller 3*a* moves (leftward in FIG. 4B), the lubricant support member 3*d* may be tilted or moved in the direction in which the surface of the applying roller 3*a* moves (leftward in FIG. 4B). As a result, a false detection may happen in which the lubricant support member 3*d* and the electrode member 41 become in a conductive state to be determined as the near-end state although the remaining amount of the solid lubricant 3*b* is sufficient enough.

Also, when a lubricant application operation is executed, the rotational movement of the applying roller 3*a* vibrates the solid lubricant 3*b* due to workload variation at the contact point between the applying roller 3*a* and the solid lubricant 3*b*. In particular, if gravity operates on the solid lubricant 3*b* in the direction opposite to the direction in which the applying roller 3*a* scrapes off the solid lubricant 3*b*, the vibration due to the workload variation becomes larger. In addition, if the applying roller 3*a* vibrates by itself while rotating, it makes the solid lubricant 3*b* vibrate. As a result, for example, even if the lubricant support member 3*d* is not tilted when a lubricant application operation is executed, which is contrary to FIG. 4B, the above vibration makes the contact between the electrode member 41 the lubricant support member 3*d* unstable when the solid lubricant 3*b* reaches the near-end state, which results in repeated switching between a conductive state and a non-conductive state. Therefore, there is a possibility that the near-end state is not indicated even if the solid lubricant 3*b* reaches the near-end state, due to a false non-conductive state caused by the vibration. Also, noise or the like may be generated due to the unstable contact caused by the vibration of the solid lubricant 3*b*, which affects the state of electrical continuity. To prevent the noise from affecting the state of electrical continuity, the electrical power needs to be set appropriately, which may consume more electrical power. Therefore, in the present embodiment, the detection of the remaining amount is executed when the lubricant application operation stops.

Figure 5:
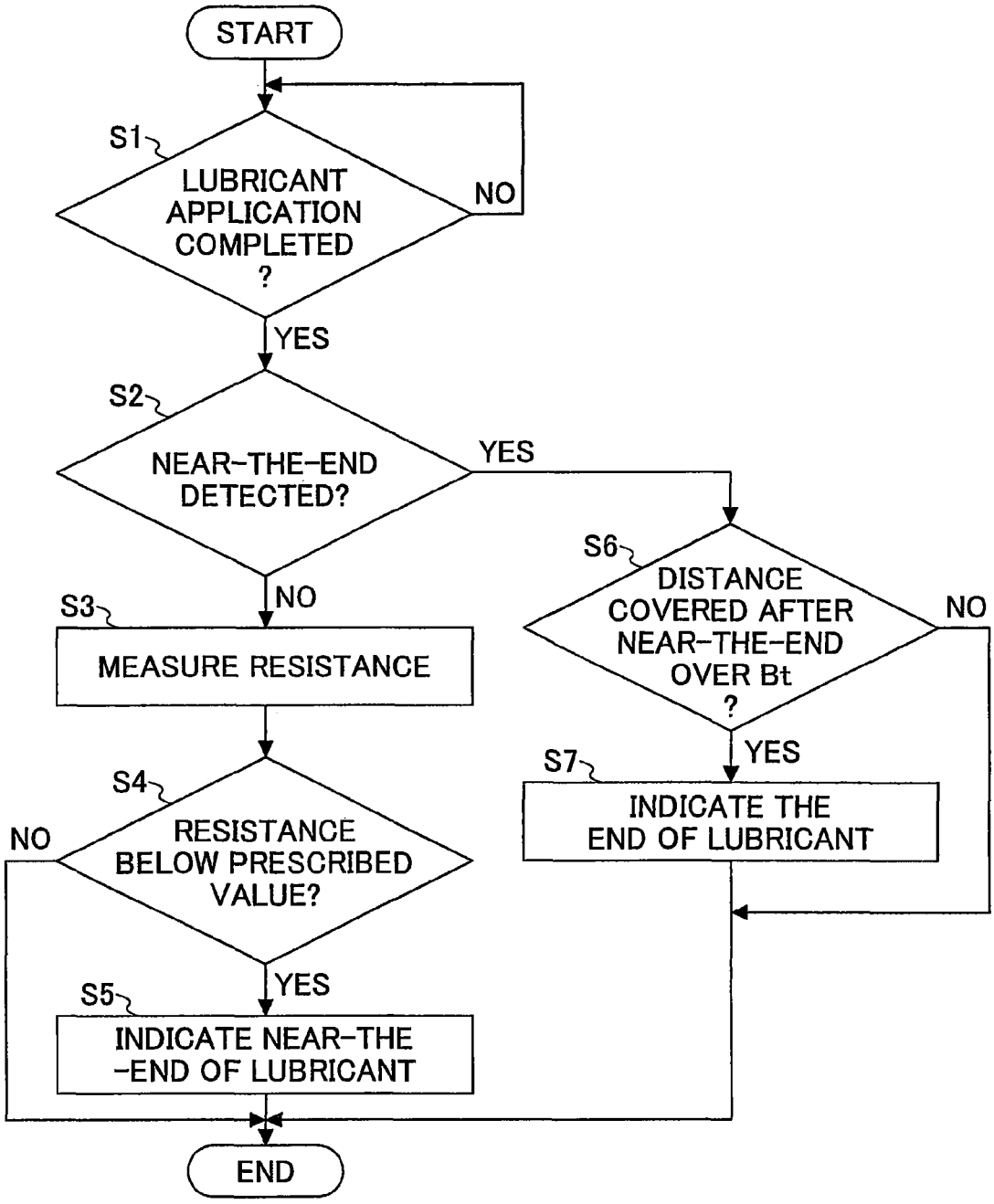
FIG. 5 is a control flowchart to detect the remaining amount of the lubricant.
Figure 10:
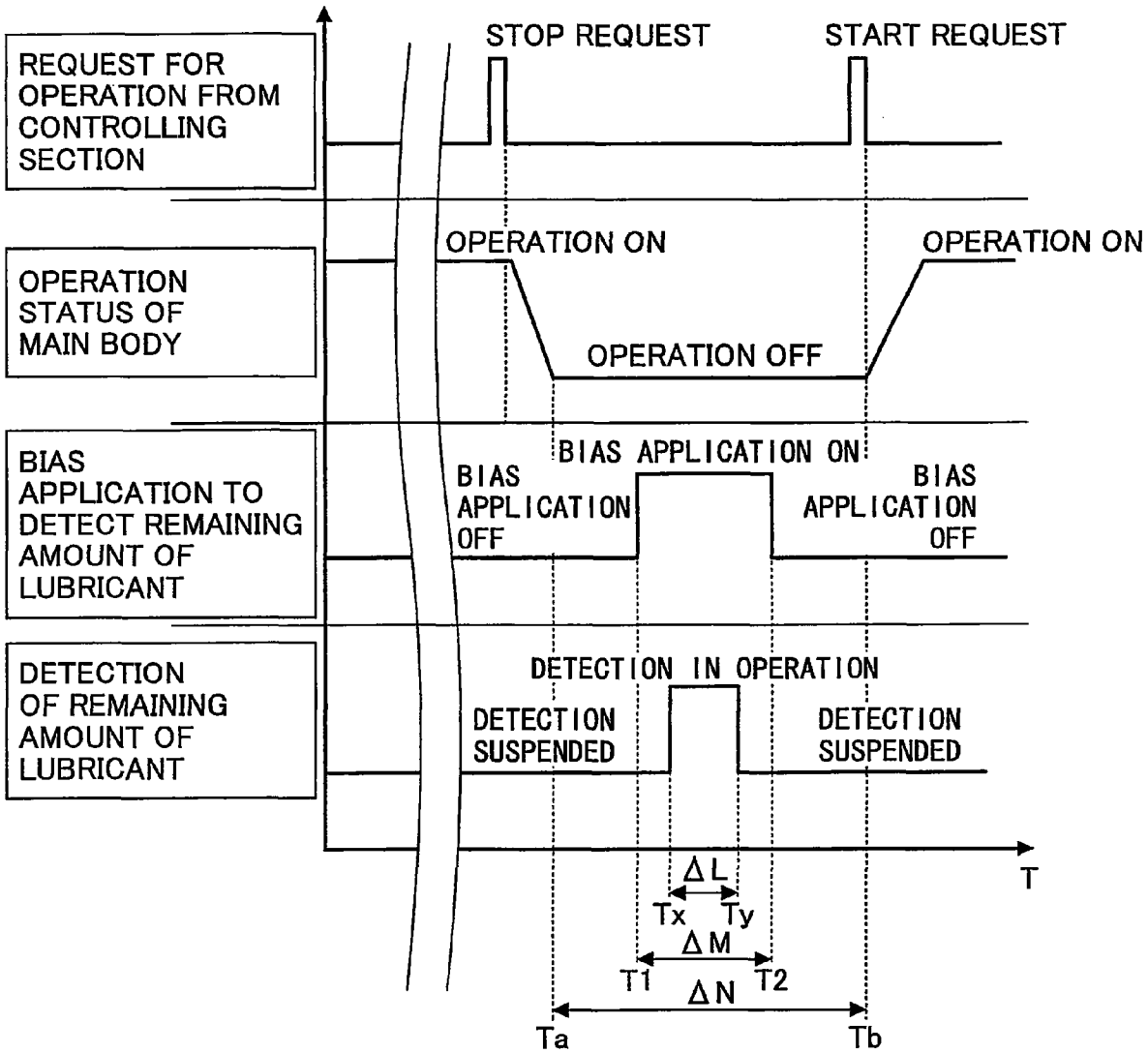
FIG. 10 is a timing chart for detecting the remaining amount of the lubricant.

FIG. 5 is a control flowchart for detecting the remaining amount of the lubricant. FIG. 10 is a timing chart for the detecting the remaining amount of the lubricant. As shown in FIG. 5, the controlling section 100 determines whether a lubricant application operation ends (Step S1). As shown in FIG. 10, a stoppage of operation is directed by a requesting signal from the controlling section 100 of the image forming apparatus. Then, a driving motor to rotate the photoreceptor drum 1 and a driving motor to rotate the applying roller 3*a* and the like are stopped (ON to OFF), and the main body of the image forming apparatus stops its operation. If the applying roller 3*a* is configured to be driven to rotate, it is possible to detect the end of a lubricant application operation by detecting that the motor driving the applying roller 3*a* is switched from ON to OFF. If the applying roller 3*a* and the photoreceptor drum 1 are configured to be driven to rotate together, it is possible to detect the end of a lubricant application operation by detecting that the motor driving the photoreceptor drum 1 is switched from ON to OFF. Alternatively, an encoder may be used to detect a stoppage of the applying roller 3*a* for detecting a lubricant application operation ends.

After the main body stops its operation at Ta, a bias application for detecting the remaining amount of the solid lubricant 3*b* is switched from OFF to ON at T1 to apply bias between the electrode member 41 and the lubricant support member 3*d* to detect the remaining amount of the solid lubricant 3*b*. The detection of the remaining amount of the solid lubricant 3*b* is started at Tx, then executed, for example, by repeating an electrical continuity test for 10 times with an interval of 0.2 s totaling 2 s, or (Tx−Ta), after the rotational movement has stopped at Ta. It is determined as the near-end state if the electrical continuity is confirmed 10 times. The execution time for detecting the remaining amount of the lubricant 3*b* is (ΔL=Ty−Tx) as shown in FIG. 10.

After the execution time for detecting the remaining amount (ΔL=Ty−Tx) has passed, the bias application for detecting the remaining amount is switched from ON to OFF at T2 to prepare for a next operation of the main body of the image forming apparatus.

In the present embodiment, the detection of the remaining amount of the lubricant 3*b* is executed within a time ΔN between the timing of the stoppage of the operation at Ta and the timing of the start of the next operation at Tb, which includes a time for electrical continuity test of ΔL from the start timing of the detection of the remaining amount at Tx, to the completion timing of the detection at Ty. Therefore, the bias application required to detect an electrical continuity is only executed during the detection of the remaining amount (in FIG. 10, the bias application is executed for a time ΔM from T1 to T2). By applying the bias between the electrode member 41 and the lubricant support member 3*d* only when detecting the remaining amount, it is possible to save electric energy.

If the next operation request from the controlling section 100 is directed before the end of the detection of the remaining amount of the solid lubricant 3*b* (Ty), the detection of the remaining amount of the solid lubricant 3*b* is stopped to start the next operation by the main body. By doing so, a downtime can be avoided, which might happen if the next operation by the main body is started after the completion of the detection of the remaining amount of the solid lubricant 3*b*.

After a lubricant application operation stops (YES at Step S1), and the near-end state has not been detected (NO at Step S2), the controlling section 100 applies a voltage between the lubricant support member 3*d* and the electrode member 41 to measure resistance at the detecting section 42 (Step S3). If the measured resistance at the detecting section 42 is below a predetermined value (YES at Step S4), it is determined as the near-end state of the solid lubricant 3*b*, which is indicated to a user to prompt that the unit needs to be exchanged soon (Step S5).

On the other hand, if the near-end state has been detected (YES at Step S2), and the distance covered by the applying roller 3*a* after the near-end state is more than a predetermined value Bt (YES at Step S6), it is determined as the end state of the solid lubricant 3*b* (Step S7) to stop further image forming operations, which is indicated to a user to prompt that the unit needs to be exchanged immediately.

As described above, the detection of the remaining amount of the solid lubricant 3*b* is executed when a lubricant application operation stops. Therefore, it is possible to execute the detection of the remaining amount of the solid lubricant 3*b* precisely. Also, since the contact between the electrode member 41 and the lubricant support member 3*d* is stable, it is possible to detect an electrical continuity between the lubricant support member 3*d* and the electrode member 41 without applying a high voltage, which makes the electrical power consumption minimum. Here, the detection of the remaining amount is executed after a lubricant application operation is completed. Alternatively, the detection of the remaining amount may be executed before a lubricant application operation. Also, the detection of the end state may be always executed instead of executed only after the near-end state detection.

Also here, the detection of the end state is determined by the distance covered by the applying roller 3*a* after the near-end state has been detected. Alternatively, the detection of the end state may be determined by the distance covered by the photoreceptor drum 1 (or the rotation time of the photoreceptor drum 1), or the number of sheets.

In the following, a specific example will be described in which the end state is detected by the number of sheets. Suppose the solid lubricant 3*b* has a lifetime for 200 k sheets and a remaining amount detecting mechanism is configured to determine the near-end state at 180 k sheets. After the remaining amount detecting mechanism (configured with the electrode member 41 the detecting section 42) detects the near-end state, the controlling section 100 starts to count the number of sheets until the number of sheets reaches a predetermined number of sheets (here, 20 k sheets), then stops operations of the main body and indicates that the lifetime of the solid lubricant 3*b* has been reached to prompt the exchange of the unit.

To improve precision of the detection of the end state, it is preferable to use the driving time of (or the distance covered by) the photoreceptor drum 1 or the applying roller 3*a*, compared to the number of sheets. Specifically, the lubricant 3*b* is consumed before and after an actual print operation because adjusting operations such as voltage or density adjustment or cleaning of remaining toner after transfer are executed while the photoreceptor drum 1 and applying roller 3*a* rotate. Suppose, for example, it takes 2 s for an image creating operation and 10 s for the adjusting operations. If 100 sheets are printed one by one, or discontinuously, it takes 12 s times 100, or 1200 s because the adjusting operations are interleaved after every image creating operation. On the other hand, if 100 sheets are printed continuously, it takes shorter time, 10 s+(2 s times 100), or 210 s. Namely, there is a large difference in the time elapsed for printing the same 100 sheets if printed in different ways. One-by-one printing takes 1200 s during which much of the solid lubricant 3*b* is consumed, whereas continuous printing takes 210 s during which less of the solid lubricant 3*b* is consumed.

Therefore, to improve precision of the detection of the end state, it is preferable to use the driving time of (or the distance covered by) the photoreceptor drum 1 or the applying roller 3*a*, because the photoreceptor drum 1 and the applying roller 3*a* rotate during the adjusting operations, which consumes the solid lubricant 3*b*.

Also, it is preferable to curb environment-dependent variation of amount of application by detecting environment parameters (temperature and/or humidity) to change the rotation rate of the applying roller 3*a*. In this case, it is preferable to detect the end state by the driving time of (or the distance covered by) the photoreceptor drum 1, or by the driving time of the applying roller 3*a*. The reason is as follows.

For example, suppose that the distance to be covered by the applying roller 3*a* is 20 km after the detection of the near-end state of the solid lubricant 3*b* until the lifetime of the solid lubricant 3*b* at normal temperature and humidity, and the end state is detected if the distance covered by the applying roller 3*a* reaches 20 km.

Suppose also that the amount of application of the lubricant in a high-temperature, high-humidity environment decreases, for example, to two-third of the amount consumed at normal temperature and humidity, hence the distance covered by the applying roller 3*a* is extended to 30 km until the lifetime of the solid lubricant 3*b*. Therefore, if the end state of the solid lubricant 3*b* is determined with 20 km of the distance covered by the applying roller 3*a*, it may be a premature determination of the end state of the solid lubricant 3*b*, which may result in an early exchange of the solid lubricant 3*b* with much remaining.

Alternatively, suppose that the amount of application of the lubricant in a low-temperature, low-humidity environment increases, for example, 1.5 times of the amount consumed at normal temperature and humidity, hence the distance covered by the applying roller 3*a* is shortened to 10 km until the lifetime of the solid lubricant 3*b*. Therefore, if the end state of the solid lubricant 3*b* is determined with 20 km of the distance covered by the applying roller 3*a*, the solid lubricant 3*b* may have been completely consumed when passing 10 km, hence the surface of the photoreceptor drum 1 does not have the lubricant applied anymore. This may cause various defects including a toner filming on the photoreceptor drum 1, a cleaning defect, an abrasion of the photoreceptor drum 1, an image with white dots, a twisted cleaning blade 8*a*, and so on.

On the other hand, if the device is configured so that the rotation rate of the applying roller 3*a* is controllable in response to the environment (temperature and humidity), it is possible to consume the same amount of the lubricant in the high-temperature and high-humidity environment as in the normal temperature and humidity environment, by setting the rotation rate of the applying roller 3*a* to 1.5 times higher than the rate at the normal temperature and humidity. Also, it is possible to consume the same amount of the lubricant in the low-temperature, low-humidity environment, by setting the rotation rate of the applying roller 3*a* to 0.5 times of the rate at the normal temperature and humidity. By setting the rotation rate of the applying roller 3*a* to 0.5 times, the driving time of the applying roller 3*a* until the end state of the solid lubricant 3*b* is the same as the time in the normal temperature and humidity environment.

Thus, if environment-dependent variation of amount of application is curved by detecting environment parameters (temperature and humidity) to change the rotation rate of the applying roller 3*a*, the end state of the solid lubricant 3*b* always comes when the driving time of the applying roller 3*a* reaches to a predetermined time regardless of environment changes. Therefore, the driving time of the applying roller 3*a* can be used to precisely determine the end state of the solid lubricant 3*b*.

Also, if the rotation rate of the applying roller 3*a* is controlled in response to the environment (temperature and humidity) as above, the driving time of the photoreceptor drum 1 is also independent of the environment. Therefore, the driving time of the photoreceptor drum 1 can be used to precisely determine the end state of the solid lubricant 3*b*. Also, the distance covered by the photoreceptor drum 1 can be used to precisely determine the end state of the lubricant because the distance covered by the photoreceptor drum 1 is calculated from the rotation rate and driving time of the photoreceptor drum 1, both of which are independent of the environment.

The amount of lubricant applied on the photoreceptor drum 1 is not uniform, but depends on the area ratio of an image formed on the surface of the photoreceptor drum 1 or the like. Specifically, there are cases in which the lubricant on the surface of the photoreceptor drum 1 is transferred to the intermediate transfer belt 56 along with a toner image created on the surface of the photoreceptor drum 1 at the first transfer of the image. In these cases, an image with a high area ratio leaves a smaller amount of lubricant on the surface of the photoreceptor drum 1 than an image with a low area ratio. As a result, an image with a high area ratio requires a larger amount of lubricant on the surface of the photoreceptor drum 1. Therefore, there is a difference in the amount of consumed lubricant between a user who frequently prints images with a low area ratio such as characters and a user who frequently prints images with a high area ratio such as pictures. This means that if images with a low area ratio are frequently printed, the distance covered by the applying roller 3*a* until the solid lubricant 3*b* reaches the near-end state becomes longer than if images with a high area ratio are frequently printed.

Thus, the distance covered by the applying roller 3*a* until the solid lubricant 3*b* reaches the near-end state depends on use conditions. Therefore, if the near-end state is detected only by the driving time or the distance covered, such as the distance covered by the applying roller 3*a*, it may be difficult to precisely detect the near-end state for all possible use conditions. Specifically, suppose that the distance covered by the applying roller 3*a* is used to detect that the solid lubricant 3*b* reaches the near-end state and the distance is set in accordance with conditions in which much lubricant is consumed. Then, if a user frequently prints images which consume less lubricant, the solid lubricant 3*b* may be prematurely exchanged without being used up to the end state. On the contrary, suppose that the distance covered by the applying roller 3*a* is used to detect that the solid lubricant 3*b* reaches the near-end state and the distance is set in accordance with conditions in which less lubricant is consumed, and a user frequently prints images which consume more lubricant, the solid lubricant 3*b* may be completely consumed before the near-end state is detected.

On the other hand, as in the present embodiment, by detecting the solid lubricant 3*b* reaches a position corresponding to the near-end state (the height of the solid lubricant 3*b* becomes a predetermined value), it is possible to precisely detect the near-end state regardless of use conditions.

Figure 6:
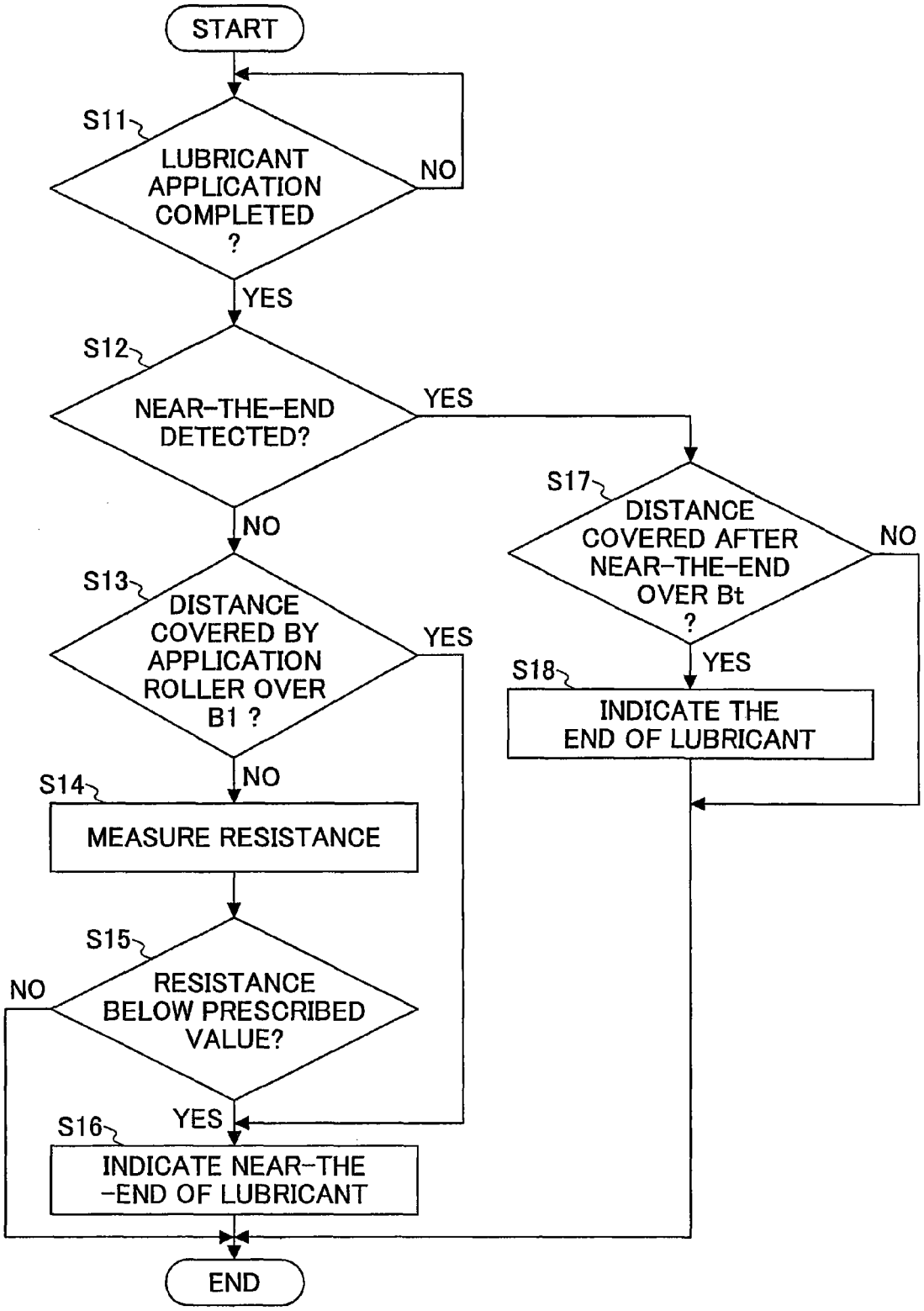
FIG. 6 is a control flowchart to execute a near-end control with both the distance covered by an applying roller and an electrical continuity between a lubricant holding member and an electrode member.

However, under a use condition where images with a low area ratio are frequently printed, some of scraped and powdered lubricant that is not applied on the photoreceptor drum 1 accumulates in the housing case 3*e*. As a result, a part of the lubricant accumulated in the housing case 3*e* may adhere to the contact point between the electrode member 41 and the lubricant support member 3*d*. If the lubricant adheres to the contact point, the lubricant support member 3*d* and the electrode member 41 do not transition to a conducting state even if contacting to each other, resulting in a detection failure of the near-end state of the solid lubricant 3*b*. As a result, image forming operations are executed without lubricant, which deteriorate the surface of the photoreceptor drum 1. Therefore, the near-end state of the solid lubricant 3*b* may be detected by using both of the distance covered by the applying roller 3*a* and an electrical continuity between the lubricant support member 3*d* and the electrode member 41. FIG. 6 is a control flowchart to detect the near-end state of the solid lubricant 3*b* by both of the distance covered by the applying roller 3*a* and an electrical continuity between the lubricant support member 3*d* and the electrode member 41.

As shown in FIG. 6, if a lubricant application operation ends (YES at Step S11), and the near-end state has not been detected (NO at Step S12), it is determined whether the distance covered by the applying roller 3*a* is over a predetermined value B1 (Step S13). If the distance covered by the applying roller 3*a* is below the predetermined value B1 (NO at Step S13), the detecting section 42 measures resistance to determined whether the resistance is below a predetermined value (Step S14). If the resistance is below the predetermined value (YES at Step S15), it is determined as the near-end state because an electrical continuity between the electrode member 41 and the lubricant support member 3*d* is detected, which is indicated to a user (Step S16). Also, if the distance covered by the applying roller 3*a* is over the predetermined value B1 (YES at Step S13), it is also determined as the near-end state because an electrical continuity between the electrode member 41 and the lubricant support member 3*d* is detected, which is indicated to a user to prompt an exchange of the solid lubricant 3*b* or the unit with a new one.

Figure 7:
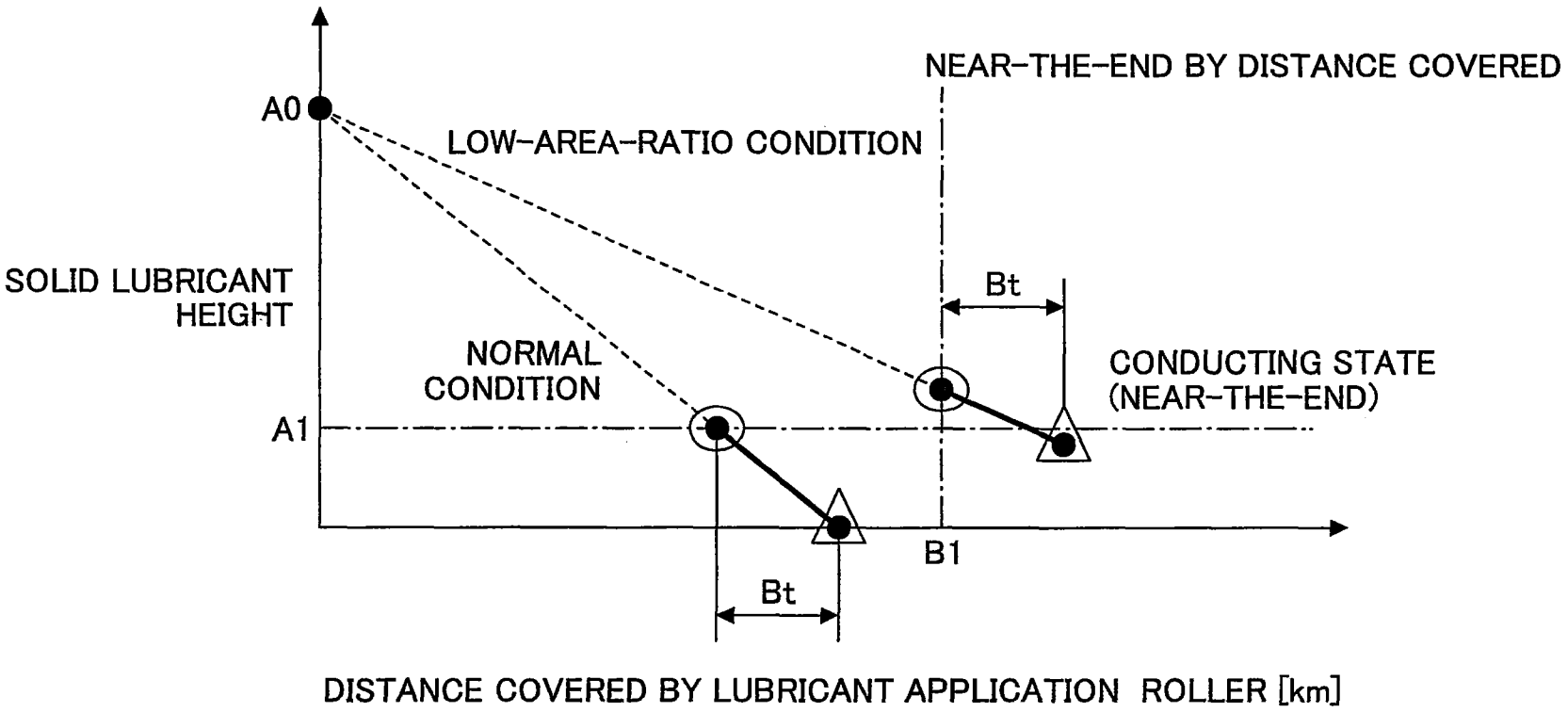
FIG. 7 is a schematic view illustrating change of the amount of the solid lubricant and a timing of a near-end detection.

FIG. 7 is a schematic view illustrating change of the remaining amount of the solid lubricant 3*b* and a timing of the near-end state detection. As shown in FIG. 7, under normal conditions, the near-end state is detected by an electrical continuity between the electrode member 41 and the lubricant support member 3*d* before the distance covered by the applying roller 3*a* is over the predetermined value B1. On the other hand, under a use condition where images with a low area ratio are frequently printed, the near-end state is detected by the distance covered by the applying roller 3*a* over the predetermined value B1 before an electrical continuity between the electrode member 41 and the lubricant support member 3*d* is detected. Then, after the near-end state is detected, if the distance covered by the applying roller 3*a* reaches an upper limit Bt, it is determined as the end state to stop further image forming operations.

For example, suppose that the near-end state is determined when the height of the solid lubricant 3*b* becomes 3 mm, which is detected by an electrical continuity between the electrode member 41 and the detecting section 42. Suppose also that under normal usage, the detecting section 42 detects the near-end state when the distance covered by the applying roller 3*a* reaches 180 km, and predetermined values are set Bt=20 km, B1=220 km. With the above setting and under a low-area-ratio condition, if the near-end state is detected when the height of the solid lubricant 3*b* is 3 mm, the distance covered by the applying roller 3*a* is 250 km, and the detecting section 42 is configured to detect the near-end state by an electrical continuity between the electrode members, the near-end state is determined when the distance covered by the applying roller 3*a* reaches 220 km and the end state is determined when the distance covered by the applying roller 3*a* reaches 240 km.

Also, for example, if high-area-ratio images are frequently printed, a greater amount of remaining toner is scraped by the cleaning blade 8*a* after transfer of images. This makes a scraping force become weak whereas the blade be worn slower. The greater amount of toner scraped by the cleaning blade 8*a* causes that additives adhering to the toner to adhere to the photoreceptor drum 1 to generate an image with white dots. Therefore, more lubricant needs to be applied to the photoreceptor drum 1 than usual.

Conversely, if low-area-ratio images are frequently printed, images with white dots are less likely to be generated. Therefore, the amount of lubricant application can be less. These examples suggest that the amount of lubricant application can be changed in response to a typical area ratio.

Also, if less lubricant is applied, the scraping force between the photoreceptor drum 1 and the cleaning blade 8*a* is stronger than when more lubricant is applied, which may wear out the cleaning blade 8*a* earlier than the lifetime of the lubricant. Therefore, by setting B1, which is a threshold value for the distance covered by the applying roller 3*a* used for detecting the near-end state, based on, for example, the lifetime of the cleaning blade 8*a* or the like, it is possible to exchange the unit before quality of images are degraded due to expiration of the lifetime of the cleaning blade 8*a*.

If the lubricant adheres to the contact point, the lubricant support member 3*d* and the electrode member 41 do not become in a conducting state even when contacting each other, resulting in a detection failure of the near-end state of the solid lubricant 3*b*. As above, a use condition in which low-surface-ratio images are frequently printed, which has a risk of causing a situation where the lubricant adheres to the contact point between the electrode member 41 and the lubricant support member 3*d*, hinders an electrical continuity between the lubricant support member 3*d* and the electrode member 41 to detect the near-end state. In such a case, the near-end state can be detected by the distance covered by the applying roller 3*a*. Therefore, it is possible to prevent the device from being continuously used without detecting the near-end state. Thus, the surface of the photoreceptor drum 1 can be securely protected by the lubricant.

Other than by the distance covered by the applying roller 3*a*, the near-end state may be detected by measuring the rotation time of the applying roller 3*a* or the like. Also, the near-end state may be also detected by the distance covered by the photoreceptor drum 1 (or the rotation time) or the number of sheets. If the applying roller 3*a* is configured to rotate, and whose rotation ratio can be controlled in response to variations in the environment, it is preferable to use the distance covered by the photoreceptor drum 1 (or the rotation time), or the rotation time of the applying roller 3*a*.

Figure 8:
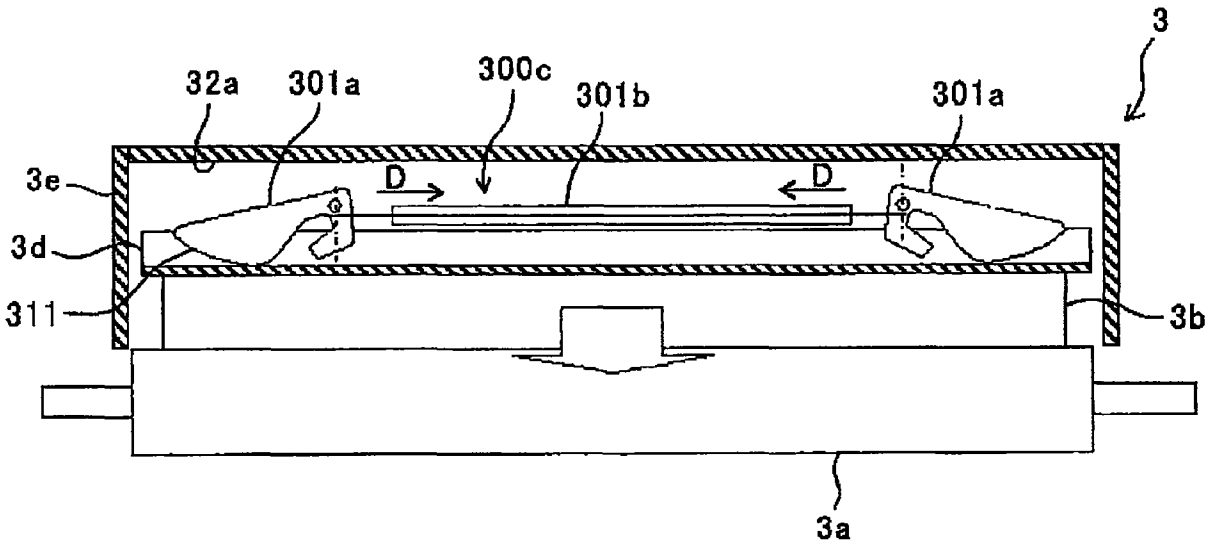
FIG. 8 is a general configuration diagram illustrating a modified example of a pressure applying mechanism.

FIG. 8 is a general configuration diagram illustrating a modified example of a pressure applying mechanism 300*c*. The pressure applying mechanism 300*c* is disposed about both ends in the longitudinal direction (the horizontal direction in FIG. 8) of the lubricant support member 3*d*, having swing members 301*a* attached to the housing case 3*e* so that the swing member 301*a* can swing about an axis, and a spring 301*b* for biasing. Each end of the spring 301*b* is attached to one of the swing members 301*a*. Each of the swing members 301*a* receives a biasing force from the spring 301*b* toward the center of the lubricant support member 3*d* in the longitudinal direction of the lubricant support member 3*d* as designated with arrows Ds in FIG. 8. With the biasing force, the swing member 301*a* at right in FIG. 8 is biased to swing counterclockwise, whereas the swing member 301*a* at left in FIG. 8 is biased to swing clockwise. Having the swing members 301*a* biased above, an arc-shaped portion of the swing member 301*a* contacting to the lubricant support member 3*d* is biased toward the lubricant support member 3*d*, or downward in FIG. 8.

At an early stage of usage of the solid lubricant 3*b*, an end of the swing member 301*a* is swung in the direction approaching toward an internal surface 32*a* of the top surface of the housing case 3*e*, against the biasing force of the spring 301*b*. With such a configuration, the swing members 301*a* receiving the biasing force from the spring 301*b* push the lubricant support member 3*d* with equivalent forces to apply pressure on the solid lubricant 3*b* held by the lubricant support member 3*d* toward the applying roller 3*a*. Therefore, the solid lubricant 3*b* receives the pressure uniformly in its longitudinal direction toward the applying roller 3*a*. As a result, the amount of lubricant scraped off by the rotation of the applying roller 3*a* is uniform in the longitudinal direction, which makes it possible to uniformly apply the lubricant on the surface of the photoreceptor drum 1.

With this modified example of the pressure applying mechanism 300*c*, it is possible to curb reduction of pressure applied to the solid lubricant 3*b* even when the height of the solid lubricant 3*b* is reduced with its usage. Therefore, it is possible to curb variations of the amount of powdered lubricant supplied on the surface of the photoreceptor drum 1 from an early stage to a later stage of usage of the solid lubricant 3*b*.

The reason why this effect can be obtained is as follows. In general, the greater the length of a spring used for applying pressure is, the smaller the variation of the biasing force of the spring when the amount of stretch of the spring is changed, which occurs from an early stage to the end of usage of the solid lubricant 3*b*. The pressure applying mechanism 3*c* shown in FIG. 3 has the pressure applying spring 31*a* contracted when a new solid lubricant 3*b* is set, whose biasing force (pushing force) is directed in the same direction as in the direction the solid lubricant 3*b* applies pressure to the applying roller 3*a*. In this configuration, the greater the length of the pressure applying spring 31*a* is, the harder the biasing force (pushing force) directed in the same direction as in the direction the solid lubricant 3*b* applies pressure to the applying roller 3*a*, which sets a limit to the total length of the pressure applying spring 31*a*. In addition, the pressure applying mechanism 3*c* in FIG. 3 needs a space for disposing the pressure applying spring 31*a* long enough to contain the length of the pressure applying spring 31*a* in the direction toward the applying roller 3*a*, which makes the device larger. For these reasons, the pressure applying mechanism 3*c* shown in FIG. 3 needs to have a relatively short spring, which makes the variation of the biasing force larger when the amount of stretch of the pressure applying spring 31*a* is changed.

Figure 9:
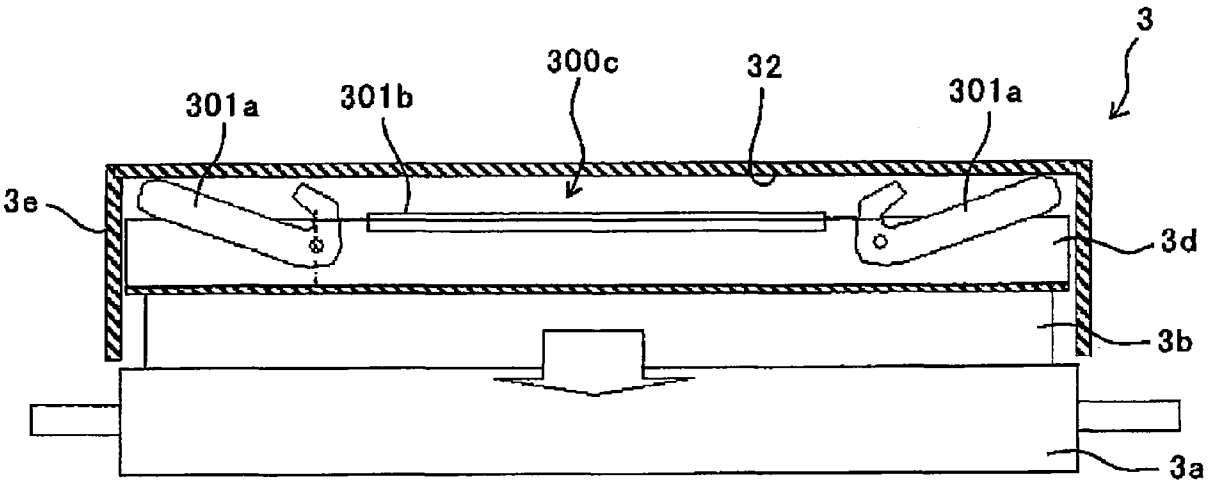
FIG. 9 is another general configuration diagram illustrating a modified example of a pressure applying mechanism.

On the other hand, with this modified example of the pressure applying mechanism 300*c*, as shown in FIG. 8, the spring 301*b* is stretched when a new solid lubricant 3*b* is set, whose biasing force (pulling force) pushes the solid lubricant 3*b* to apply pressure on the applying roller 3*a*. Therefore, the problem with the pressure applying mechanism 3*c* in FIG. 3 does not arise even if the length of the spring 301*b* is greater. Moreover, with this modified example of the pressure applying mechanism 300*c*, the spring 301*b* is disposed so that the longitudinal direction of the solid lubricant 3*b* coincides with the shaft direction of the applying roller 3*a*. Therefore, if the length of the spring 301*b* is made greater, the space for disposing the device does not need to be expanded toward the applying roller 3*a*, hence the device does not need to be enlarged. For these reasons, this modified example of the pressure applying mechanism 300*c* can adopt the spring 301*b* having a much greater length than the pressure applying spring 31*a* of the pressure applying mechanism 3*c* shown in FIG. 3. As a result, it is possible to curb the variation of the biasing force when the amount of stretch of the pressure applying spring 301*b* is changed Alternatively, as shown in FIG. 9, the swing members 301*a* may be attached to the lubricant support member 3*d* so that the swing members 301*a* can swing. In this configuration in FIG. 9, the swing member 301*a* receives a biasing force from the spring 301*b* toward the center of the lubricant support member 3*d* in the longitudinal direction of the lubricant support member 3*d*, which makes the swinging end of each of the swing member 301*a* be biased in the direction away from the lubricant support member 3*d* to make contact with an internal surface 32*a* of the top surface of the housing case 3*e*.

Furthermore, the detection of the near-end state of the solid lubricant 3*b* is not limited as described above, but, for example, a push switch may be used instead of the electrode member 41. In this case, when the lubricant support member 3*d* reaches a position corresponding to the near-end state of the solid lubricant 3*b*, the lubricant support member 3*d* pushes the push switch to indicate the near-end state. Also in this case, if the detection of the near-end state of the solid lubricant 3*b* is executed while a lubricant application operation is executed, there is a risk that a false detection may arise due to the vibration of the lubricant support member 3*d* that makes pressure applied to the push switch unstable. Therefore, also in this case, by executing the detection of the remaining amount of the solid lubricant 3*b* while the lubricant application operation stops, it is possible to execute the detection of the remaining amount of the solid lubricant 3*b* precisely.

Next, modified examples of the detection of the remaining amount will be described.

First Modified Example

Figure 11A:
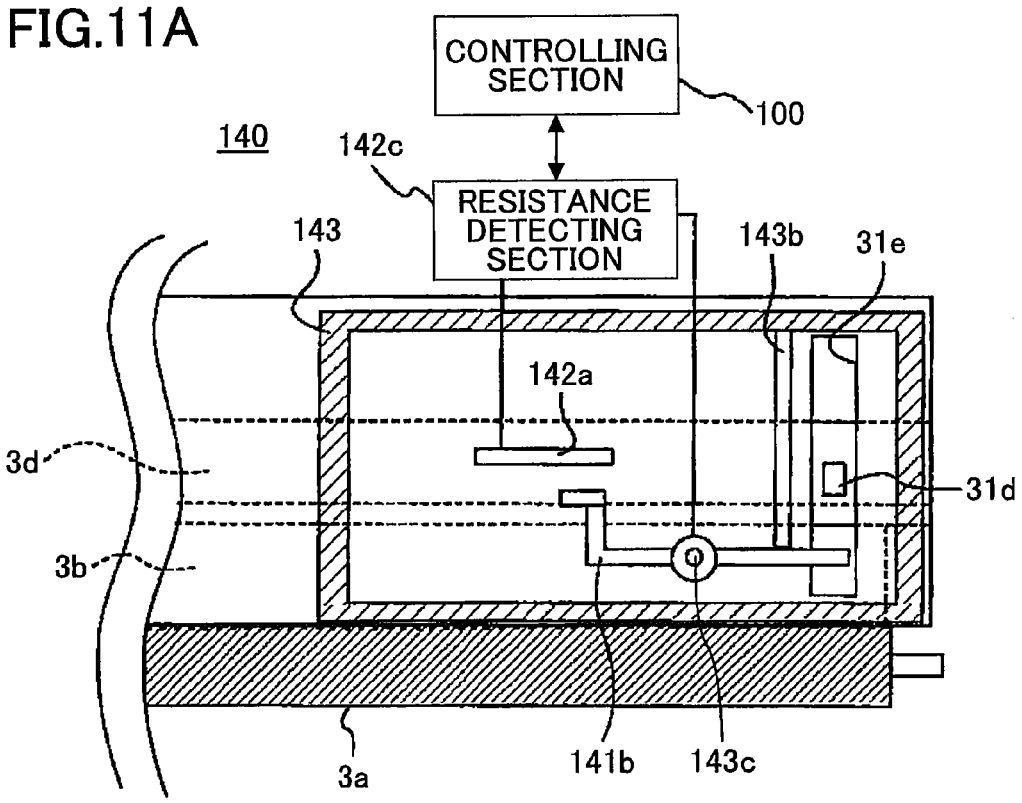
FIGS. 11A-11B are general configuration diagrams of the remaining amount detecting section of a first modified example.
Figure 11B:
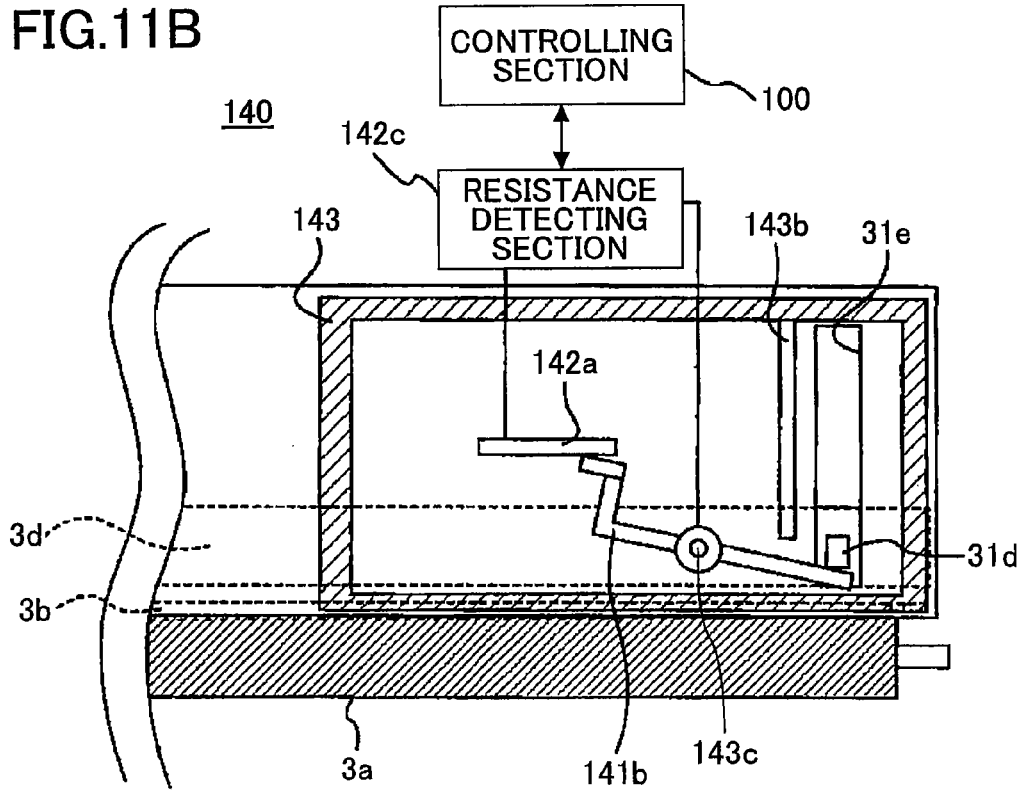
Figure 12A:
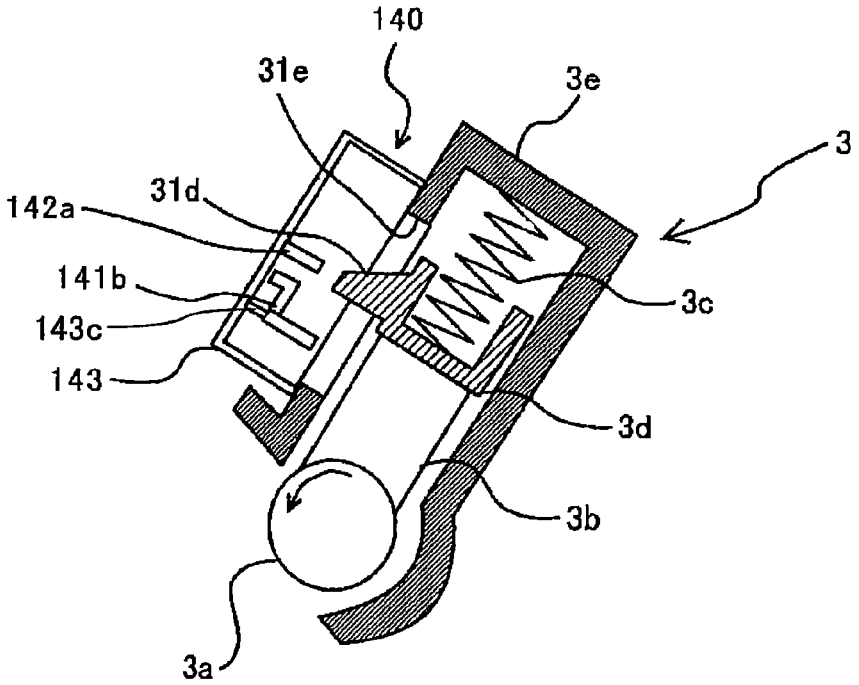
FIGS. 12A-12B are cross-sectional views of a first modified example.
Figure 12B:
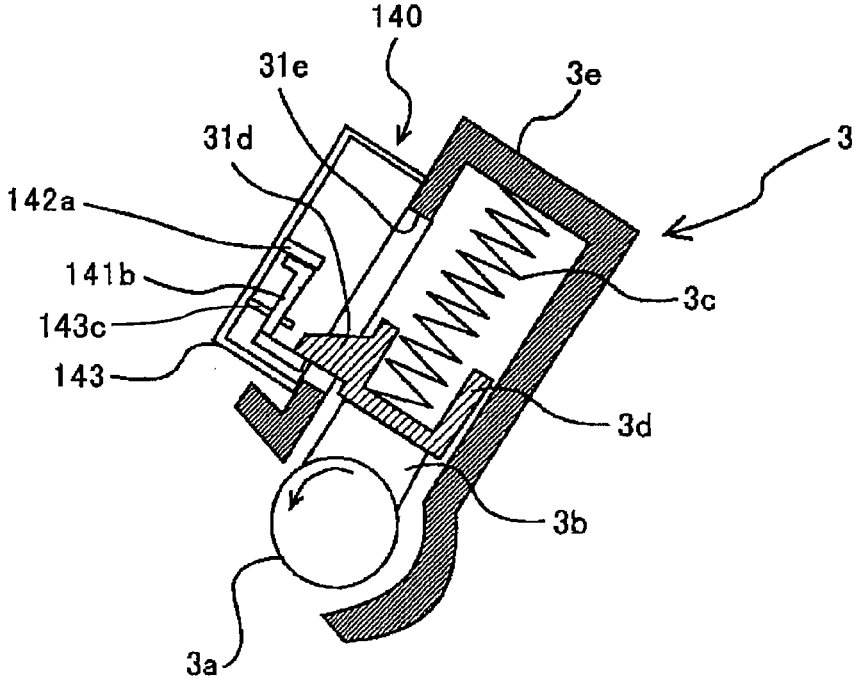

FIGS. 11A-11B are general configuration diagrams of the first modified example of the remaining amount detecting section 140. FIGS. 12A-12B are cross-sectional views of the first modified example. In FIGS. 12A-12B, a partition wall 143*b* is not shown. As shown in FIG. 11A, in the first modified example, a rotational electrode 141*b*, an electrode 142*a* that comes into contact with the rotational electrode 141*b* when the solid lubricant 3*b* becomes the near-end state, a resistance detecting section 142*c* and the like are included. The resistance detecting section 142*c* is connected with the electrode 142*a* and the rotational electrode 141*b* to apply a voltage between the electrode 142*a* and the rotational electrode 141*b* for measuring electronic resistance. The rotational electrode 141*b* and the electrode 142*a* are appropriately positioned and supported in a cover member 143. The electrode 142*a* is disposed over the rotational electrode 141*b* in the vertical direction.

An opening 31*e* is provided on the side surface of the housing case 3*e*, or the side surface positioned upper in FIG. 12A-12B, extended in the moving direction of 3*d*.

A contact projection 31*d* is disposed on the lubricant support member 3*d* so that the contact projection 31*d* gets into the opening 31*e* (see FIG. 12A-12B). Also, the cover member 143 includes the partition wall 143*b* that separates the space in the cover member 143 into a subspace where the opening 31*e* is disposed, and a subspace where the electrode 142*a* is disposed.

The rotational electrode 141*b* is held by a rotational shaft 143*c* disposed in the cover member 143 so that the rotational electrode 141*b* can rotate about the cover member 143. As shown in FIG. 12A, at an early stage of usage, the contact projection 31*d* disposed on the lubricant support member 3*d* is separated from the rotational electrode 141*b*, and the rotational electrode 141*b* makes contact with the partition wall 143*b* by its own weight to prevent the rotational electrode 141*b* from rotating. At this moment, the rotational electrode 141*b* is separated from the electrode 142*a*. Therefore, at this moment, if the resistance detecting section 142*c* applies a voltage between the electrode 142*a* and the rotational electrode 141*b*, a current does not flow between the electrode 142*a* and the rotational electrode 141*b*, which makes impossible to measure electrical resistance.

When the solid lubricant 3*b* is scraped to be consumed and the height of the solid lubricant 3*b* is reduced, the lubricant support member 3*d* approaches the applying roller 3*a*. When the height of the solid lubricant 3*b* reaches the predetermined value, the contact projection 31*d* disposed on the lubricant support member 3*d* comes into contact with the rotational electrode 141*b*. When the solid lubricant 3*b* is scraped more and the height of the solid lubricant 3*b* is reduced more, the contact projection 31*d* pushes the right end of the rotational electrode 141*b* in FIG. 11*b* to rotate the rotational electrode 141*b* in the reverse direction (clockwise in FIG. 11) to the rotational direction of the rotational electrode 141*b* by its own weight. When the amount of the solid lubricant 3*b* becomes only a small amount (near-end) as shown in FIGS. 11B and 12B, the rotational electrode 141*b* comes into contact with the electrode 142*a*. When the rotational electrode 141*b* comes into contact with the electrode 142*a*, the rotational electrode 141*b* and the electrode 142*a* transition from a non-conductive state to a conductive state. At this moment, if the resistance detecting section 142*c* applies a voltage between the electrode 142*a* and the rotational electrode 141*b*, a current flows between the electrode 142*a* and the rotational electrode 141*b*. As a result, the resistance detecting section 142*c* measures electrical resistance, with which the rotation of the rotational electrode 141*b* due to consumption of the solid lubricant 3*b* is detected, which indicates the near-end state of the solid lubricant 3*b*.

The remaining amount detecting section 140 of the first modified example uses the rotational electrode 141*b* that rotates in response to consumption of the solid lubricant 3*b*. The rotational electrode 141*b* has a portion that comes into contact with the contact projection 31*d*, and at the opposing side across the rotational shaft from the portion, has another portion that comes into contact with the electrode 142*a* for detecting the near-end state of the solid lubricant 3*b*. Configuring in this way, as shown in FIGS. 12A-12B, the contact point between the electrode 142*a* and the rotational electrode 141*b* can be disposed at a position away from the contact point between the solid lubricant 3*b* and the applying roller 3*a*. This prevents powdered lubricant scraped by the applying roller 3*a* from adhering to the contact point between the electrode 142*a* and the rotational electrode 141*b*. This prevents an electrical continuity defect from being generated by the lubricant adhered to the electrode members, which makes it possible to detect the near-end state of the solid lubricant 3*b* precisely.

Also, it is possible to prevent scattered lubricant powder from adhering to the electrode 142*a* or the contact point between the electrode 142*a* and the rotational electrode 141*b* because the remaining amount detecting section 140 is disposed outside of the housing case 3*e*.

Also in this modified example, the electrode members are generally disposed at upper positions, for example, the contact point between the electrode 142*a* and the rotational electrode 141*b* is positioned above the contact point between the contact projection 31*d* and the rotational electrode 141*b*. This prevents powdered lubricant entered through the opening 31*e* from adhering to the electrode 142*a*. Also, by positioning the contact point between the electrode 142*a* and the rotational electrode 141*b* above the contact point between the contact projection 31*d* and the rotational electrode 141*b*, the electrode 142*a* can be disposed at a vertically upper position even if the rotational amount of the rotational electrode 141*b* is small.

Moreover, the partition wall 143*b* separates the space in the cover member 143 into a subspace where the opening 31*e* is disposed, and a subspace where the electrode 142*a* is disposed. This prevents powdered lubricant entered through the opening 31*e* from adhering to the electrode 142*a* even further. Here, it is preferable to mold the cover member 143 and the partition wall 143*b* as a single piece made of resin. This reduces the number of parts, which makes the cost of the device lower than when configuring the cover member 143 and the partition wall 143*b* as separate parts. Also, the partition wall 143*b* may be attached to the housing case 3*e*. Here again, by molding the housing case 3*e* and the partition wall 143*b* as a single piece made of resin, it is possible to reduce the number of parts, which makes the cost of the device lower. Also, by providing partition walls on the cover member 143 and the housing case 3*e*, respectively, and combining them, the space in the cover member 143 may be separated into a subspace where the opening 31*e* is disposed, and a subspace where the electrode 142*a* is disposed.

Also, the cover member 143 covers the opening 31*e*, the electrode 142*a*, and the rotational electrode 141*b*. This prevents powdered lubricant from scattering out of the lubricant applying device 3 through the opening 31*e*, which prevents the device from being dirty. This also prevents scattered toner or the like from adhering to the electrode 142*a* or the contact point between the rotational electrode 141*b* and the electrode 142*a*, which prevents an electrical continuity defect from being generated between the electrode members.

Also in this modified example, the rotational electrode 141*b* and the electrode 142*a* are appropriately positioned and supported in the cover member 143. By positioning and supporting the rotational electrode 141*b* and the electrode 142*a* in the same member, component tolerance can be minimized, which makes it possible to precisely position the electrode 142*a* and the rotational electrode 141*b* relative to each other. This makes it possible to have the electrode 142*a* come into contact with the rotational electrode 141*b* when the solid lubricant 3*b* reaches the near-end state, which makes it possible to detect the near-end state of the solid lubricant 3*b* precisely. Also, just by detaching the cover member 143 from the housing case 3*e*, the remaining amount detecting section 140 can be detached from the lubricant applying device 3, which makes an exchange operation of the remaining amount detecting section 140 easier.

Second Modified Example

Figure 13A:
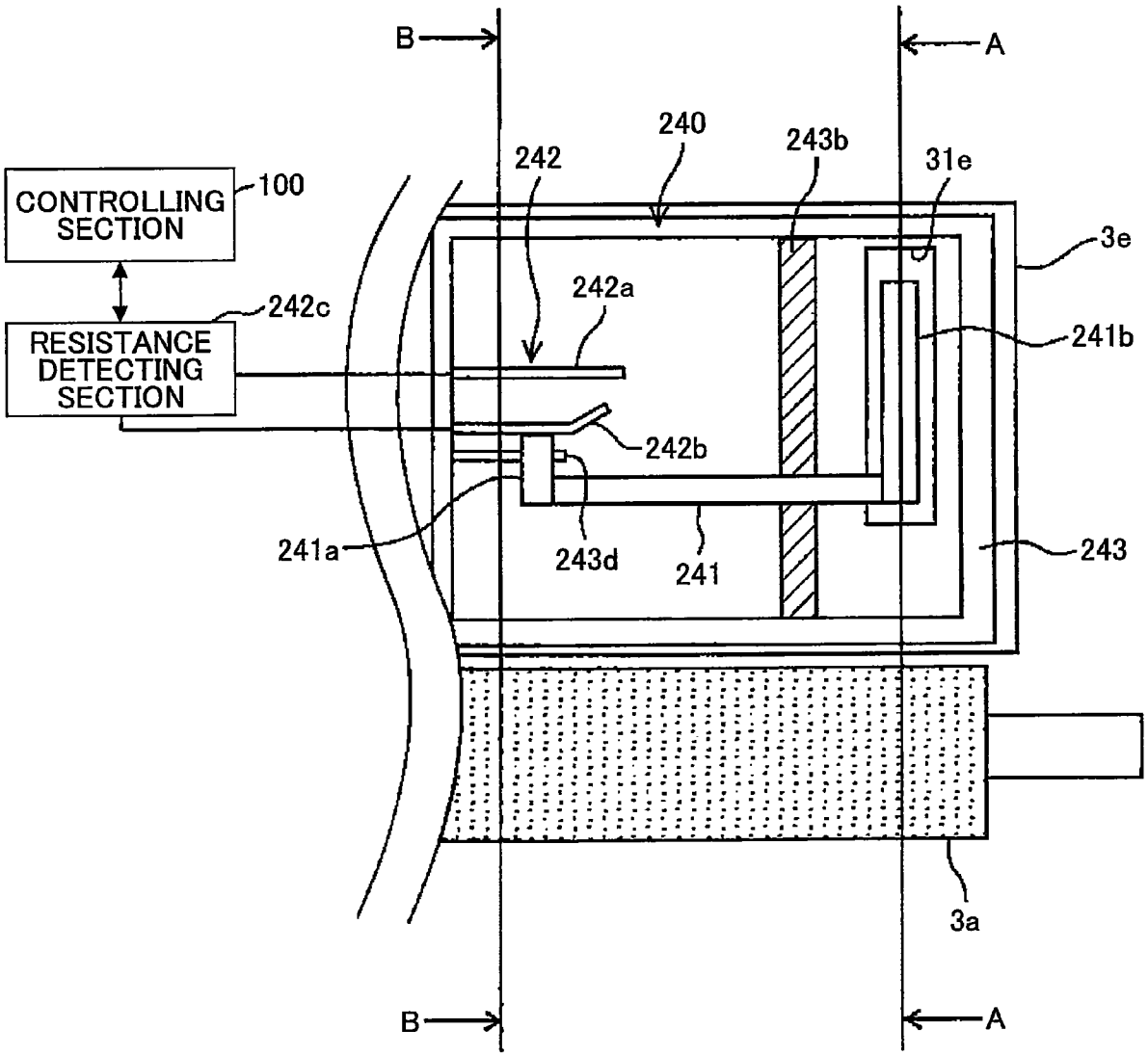
FIGS. 13A-13B are general configuration diagrams of the remaining amount detecting section of a second modified example.
Figure 13B:
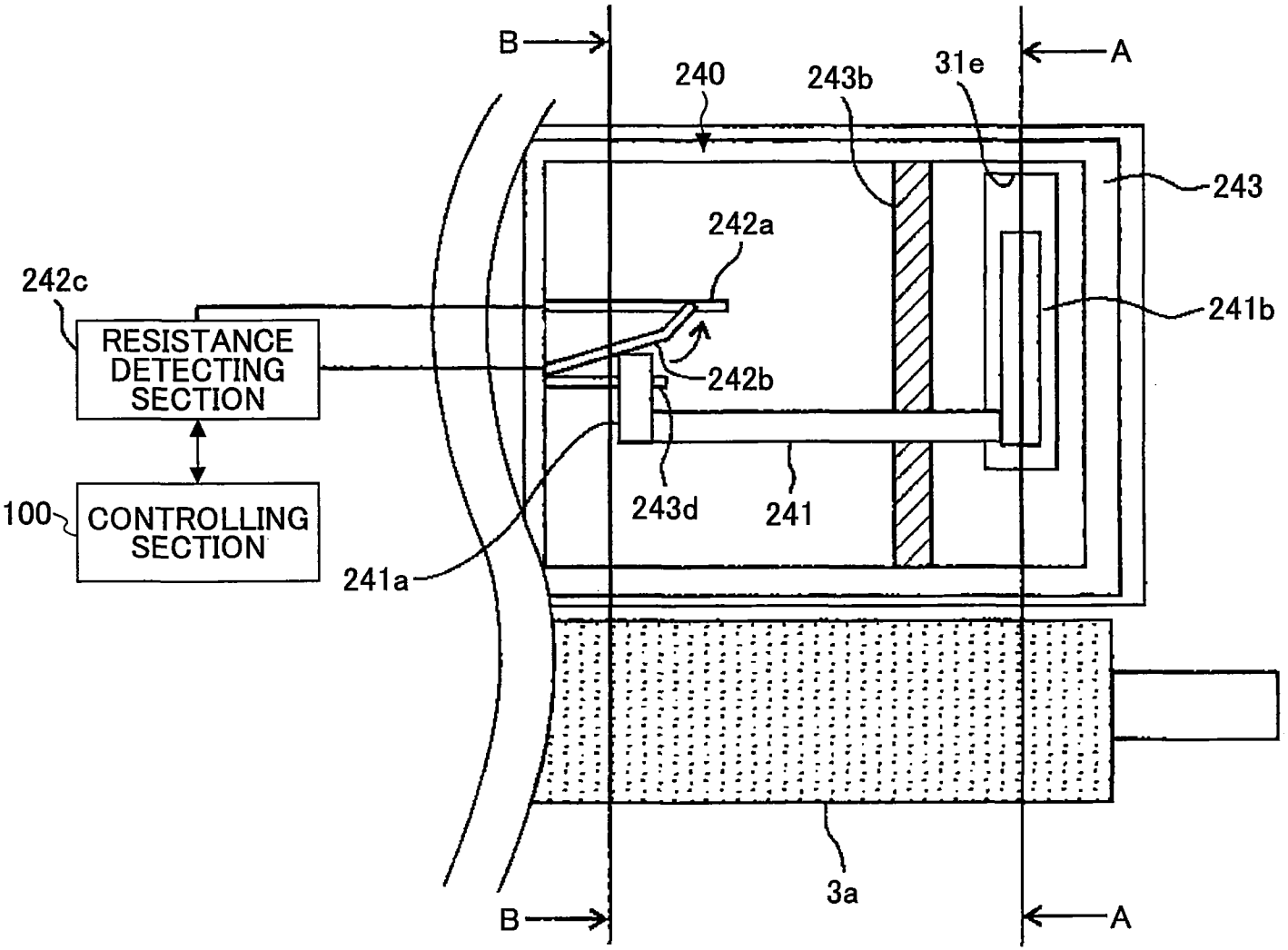
Figure 14A:
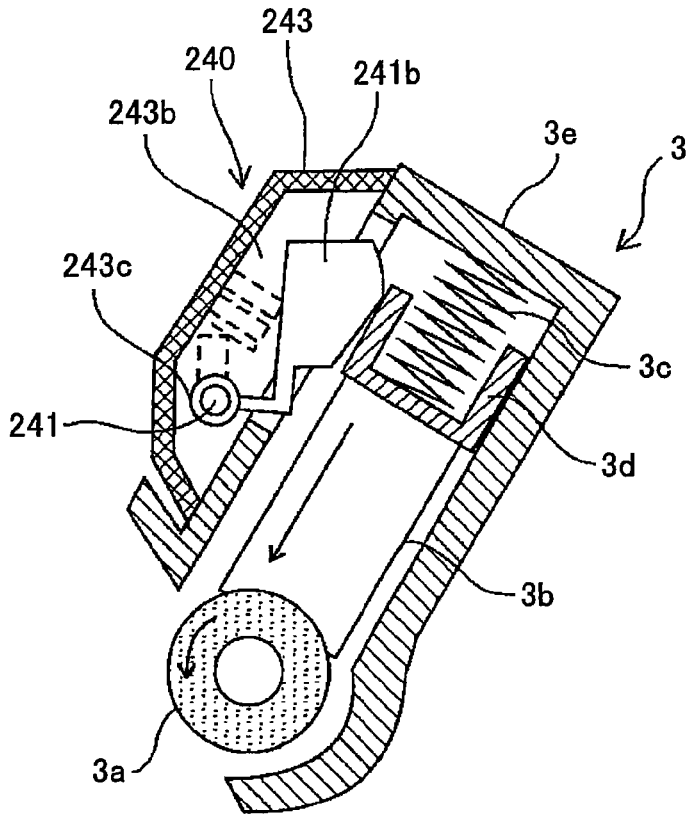
FIGS. 14A-14B are cross-sectional views of FIGS. 13A-13B taken along the line A-A.
Figure 14B:
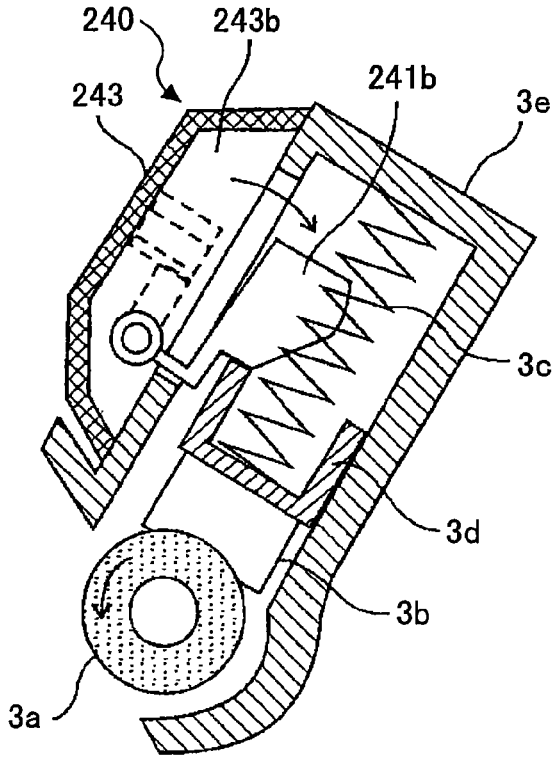
Figure 15A:
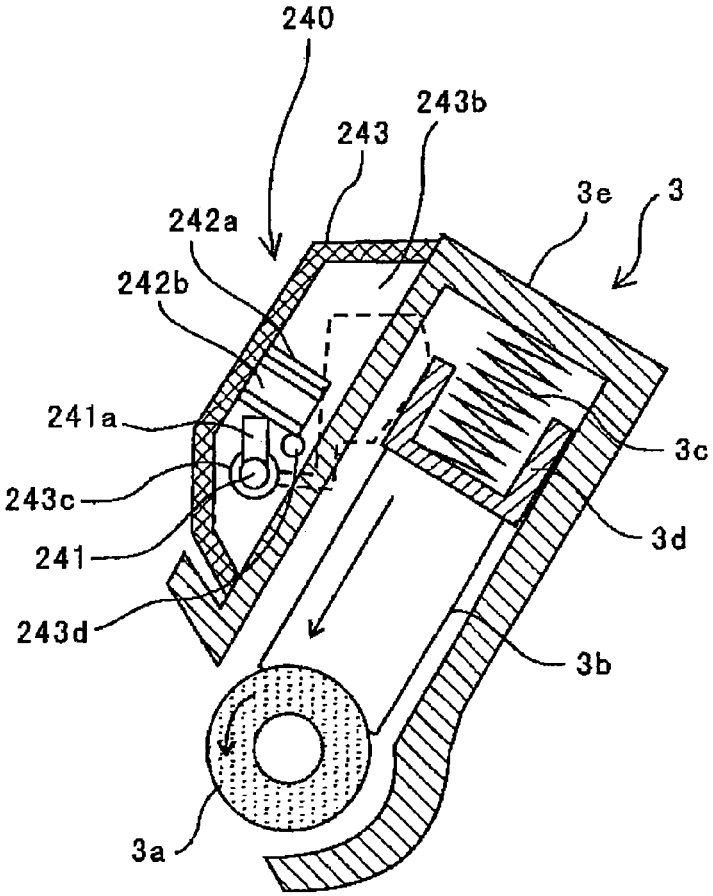
FIGS. 15A-15B are cross-sectional views of FIGS. 13A-13B taken along the line B-B.
Figure 15B:
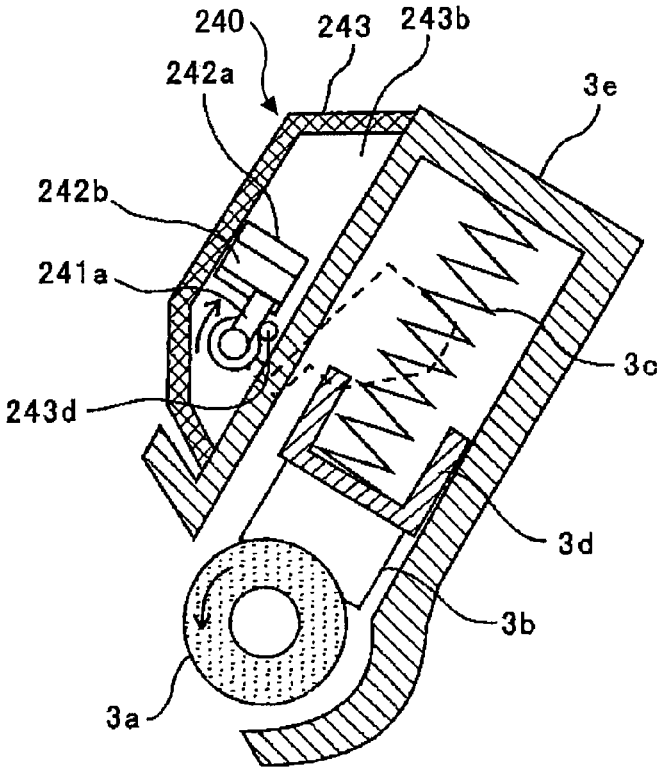

FIGS. 13A-13B are general configuration diagrams of the second modified example of a remaining amount detecting section 240. FIGS. 14A-14B are cross-sectional views of FIGS. 13A-13B taken along the line A-A. FIGS. 15A-15B are cross-sectional views of FIGS. 13A-13B taken along the line B-B. FIG. 13A, FIG. 14A, and FIG. 15A are general configuration diagrams when the solid lubricant 3*b* is at an early stage of its usage, whereas FIG. 13B, FIG. 14B, and FIG. 15B are general configuration diagrams when the solid lubricant 3*b* becomes only a small amount (the near-end state). Also, the other end of the lubricant applying device 3 in the longitudinal direction (not shown) is configured in the same way as in the end described here.

This second modified example of the remaining amount detecting section 240, as shown in FIGS. 13A-13B, has a rotational member 241 and a rotation detecting section 242 to detect rotational movement of the rotational member 241. The rotation detecting section 242 has a first electrode member 242*a*, a second electrode member 242*b* disposed at a position opposite to the first electrode member 242*a*, a resistance detecting section 242*c* and the like. The resistance detecting section 242*c* is connected with the first electrode member 242*a* and the second electrode member 242*b* to apply a voltage between the first electrode member 242*a* and the second electrode member 242*b* for measuring electronic resistance. The resistance detecting section 242*c* is also connected with the controlling section 100. The rotational member 241, the first electrode member 242*a*, and the second electrode member 242*b* are appropriately positioned and supported in a cover member 243.

The first electrode member 242*a* and the second electrode member 242*b* are made of a conductive material such as a metal plate. The left end in FIGS. 13A-13B of the second electrode member 242*b* (the end in the longitudinal direction of the solid lubricant 3*b*) is held by the cover member 243 so that the second electrode member 242*b* can be bent toward the first electrode member 242*a*. Also, the right end in FIGS. 13A-13B of the second electrode member 242*b* is folded toward the first electrode member 242*a*.

Also, an opening 31*e* is provided on the side surface of the housing case 3*e*, or the side surface positioned upper in FIGS. 14A-14B, extended in the moving direction of the lubricant support member 3*d*. At one end of the rotational member 241 (the right end in FIGS. 13A-13B), a contact portion 241*b* is disposed, which makes contact with the lubricant support member 3*d* through the opening 31*e*. At the other end of the rotational member 241, a detecting portion 241*a* is disposed, which pushes the second electrode member 242*b* to come into contact with the first electrode member 242*a* to detect that the rotational member 241 has been rotated.

The contact portion 241*b* includes, as shown in FIGS. 14A-14B, a part extended from the shaft of the rotational member 241 to the opening 31*e* with a predetermined length, a plate-shaped part extended vertically from the end of the above part, and directed in the direction perpendicular to the longitudinal direction of the solid lubricant 3*b*. Having the contact portion 241*b* configured as above, the rotational member 241 rotates counterclockwise in FIGS. 14A-14B by its own weight. Also as shown in FIGS. 14A-14B, the lubricant applying device 3 is tilted rightward relative to the vertical direction. Therefore, by disposing the remaining amount detecting section 240 on a side surface of the housing case 3*e* which is positioned upper than the lubricant support member 3*d*, it is possible to make the contact portion 241*b* rotate for coming into contact with the lubricant support member 3*d* by its own weight.

Also, the cover member 243 includes a partition wall 243*b* that separates the space in the cover member 243 into a subspace where the opening 31*e* is disposed, and a subspace where the first electrode member 242*a* and the second electrode member 242*b* are disposed. The rotational member 241 penetrates a through hole 243*c* disposed on the partition wall 243*b*, as shown in FIGS. 13A-13B and 14A-14B. The end of the rotational member 241 having the contact portion 241*b* is positioned in the space formed with the opening 31*e*. The other end of the rotational member 241 having the detecting portion 241*a* is positioned in the space where the first electrode member 242*a* and the second electrode member 242*b* are provided.

Also, on a side wall of the cover member 243, a rotation limiting part 243*d* is disposed to limit rotational movement of the rotational member 241. The rotation limiting part 243*d* extends from the side wall of the cover member 243, which is a side wall of the cover member 243 close to the center of the solid lubricant 3*b* in the longitudinal direction (the left side wall in FIGS. 13A-13B), to the rotational member 241, whose end is positioned opposite to the detecting portion 241*a* with a predetermined interval, as shown in FIG. 15A.

As shown in FIG. 14A, at an early stage of usage, the contact portion 241*b* of the rotational member 241 makes contact with the lubricant support member 3*d*, which prevents the rotational member 241 from rotating by its own weight. At this moment, as shown in FIG. 13A and FIG. 15A, the detecting portion 241*a* of the rotational member 241 does not push the second electrode member 242*b*, and the second electrode member 242*b* is separated from the first electrode member 242*a*. Therefore, at this moment, if the resistance detecting section 242*c* applies a voltage between the first electrode member 242*a* and the second electrode member 242*b*, a current does not flow between the first electrode member 242*a* and the second electrode member 242*b*, which makes it impossible to measure electrical resistance.

When the solid lubricant 3*b* is scraped to be consumed and the height of the solid lubricant 3*b* is reduced, the lubricant support member 3*d* approaches the applying roller 3*a*. When the height of the solid lubricant 3*b* becomes smaller than the predetermined value (the near-end state), the contact portion 241*b* is separated from the side surface of the lubricant support member 3*d*. Then, the rotational member 241 rotates by its own weight, and the detecting portion 241*a* pushes the second electrode member 242*b*. This makes the second electrode member 242*b* bend toward the first electrode member 242*a* as shown in FIG. 13B, to make the end of the second electrode member 242*b* (the right end in FIG. 13B) come into contact with the first electrode member 242*a*. When the second electrode member 242*b* comes into contact with the first electrode member 242*a*, the second electrode member 242*b* and the first electrode member 242*a* transition from a non-conductive state to a conductive state. At this moment, if the resistance detecting section 242*c* applies a voltage between the first electrode member 242*a* and the second electrode member 242*b*, a current flows between the first electrode member 242*a* and the second electrode member 242*b*. As a result, the resistance detecting section 242*c* measures electrical resistance, with which the rotation of the rotational member 241 is detected, to indicate the near-end state of the solid lubricant 3*b*.

With the second modified example, the first electrode member 242*a* and the second electrode member 242*b* are in a non-conductive state until the solid lubricant 3*b* becomes the near-end state, which prevents a current from flowing even if a voltage is applied between the first electrode member 242*a* and the second electrode member 242*b*. This prevents electric power from being consumed every time the detecting operation for determining the near-end state is executed, which reduces electric power consumption. Also, the rotation detecting section 242 is configured with the first electrode member 242*a* and the second electrode member 242*b* made of a relatively inexpensive material such as a metal plate, which makes the rotation detecting section 242 inexpensive.

Also, the remaining amount detecting section 240 of the second modified example detects the near-end state of the solid lubricant 3*b* by having the end of the rotational member 241 in the longitudinal direction of the solid lubricant 3*b* make contact with the lubricant support member 3*d*, disposing the detecting portion 241*a* at the other end of the rotational member 241, and detecting rotational movement of the detecting portion 241*a* by the rotation detecting section 242. Configuring in this way, as shown in FIG. 13A, the detecting section for the near-end state of the solid lubricant 3*b* (the contact point between the first electrode member 242*a* and the second electrode member 242*b*) can be disposed at a position away from the opening 31*e*. This prevents an electrical continuity defect from being generated by lubricant adhered to the electrode members, which makes it possible to detect the near-end state of the solid lubricant 3*b* precisely.

Also, it is possible to adopt a configuration in which a photointerrupter detects the near-end state of the solid lubricant 3*b*. In this case, a photointerrupter is disposed instead of the electrode members. When the lubricant support member 3*d* reaches the position corresponding to the near-end state of the solid lubricant 3*b*, the lubricant support member 3*d* interrupts light emitted from the photointerrupter, with which the near-end state is detected. Also in this case, if the detection of the near-end state of the solid lubricant 3*b* is executed while a lubricant application operation is being executed, there is a risk of a false detection due to the vibration of the lubricant support member 3*d*. Therefore, also in this case, by executing the detection of the remaining amount of the solid lubricant 3*b* while a lubricant application operation is stopped, it is possible to execute the detection of the near-end state of the solid lubricant 3*b* precisely. Alternatively, a photoreflector may be used to detect the near-end state of the solid lubricant 3*b*. In this case, a photoreflector and a reflective plate are disposed opposite to each other about the position corresponding to the near-end state of the solid lubricant 3*b*, to detect the near-end state.

The above lubricant applying device 3 can be used as a lubricant applying device for applying lubricant on the intermediate transfer belt 56.

In addition to the examples above, various aspects of the invention have specific effects as follows.

Aspect 1

A lubricant supplying device includes a solid lubricant such as the solid lubricant 3*b*, a supplying member such as the applying roller 3*a* to supply lubricant taken from the solid lubricant 3*b* to an object to be supplied with the lubricant such as the photoreceptor drum 1, a remaining amount detecting section (in the present aspect, it may be configured with the lubricant support member 3*d*, the electrode member 41, the detecting section 42 and the controlling section 100) to detect that the remaining amount of the solid lubricant 3*b* becomes below a predetermined value. A detection of the remaining amount of the solid lubricant 3*b* is executed when an operation to supply the lubricant to the object to be supplied with the lubricant stops.

Configured in this way, as described in the embodiments, it is possible to detect that the remaining amount of the solid lubricant 3*b* is below the predetermined value precisely.

Aspect 2

The lubricant supplying device as described in Aspect 1, wherein the remaining amount detecting section includes a first conductive member attached to the solid lubricant 3*b* (in the present aspect, it may be configured with the lubricant support member 3*d*), and a second conductive member either coming into contact with the first conductive member, or separating from the first conductive member, when the remaining amount of the solid lubricant becomes below a predetermined value. The detection of the remaining amount of the solid lubricant is executed based on a state of electrical continuity between the first conductive member and the second conductive member.

Configured in this way, the device can be made inexpensive with using a relatively inexpensive material such as a metal plate for the first and second conductive members to configure the remaining amount detecting section. It is less expensive than when configured with an expensive member such as a photo sensor.

Aspect 3

The lubricant supplying device as described in Aspect 2, wherein the remaining amount detecting section is configured so that the electrical continuity between the first conductive member and the second conductive member is taken at multiple positions on the solid lubricant along the longitudinal direction of the solid lubricant.

Configured in this way, if amounts of lubricant consumption are different at positions along the longitudinal direction of the solid lubricant 3*b*, the state of electrical continuity between the first conductive member and the second conductive member at the highest consumption position changes first, with which it is possible to detect the remaining amount of the solid lubricant becoming below the predetermined value. This makes it possible to prevent the surface of the photoreceptor drum 1 from being deteriorated by coming into contact with the lubricant support member 3*d*, which might happen if lack of the lubricant at the highest consumption position of the solid lubricant 3*b* is not detected.

Aspect 4

The lubricant supplying device as described in Aspect 3, wherein the electrical continuity between the first conductive member and the second conductive member is taken at least at both ends of the solid lubricant in the longitudinal direction of the solid lubricant.

If amounts of lubricant consumption are different at both ends in the longitudinal direction of the solid lubricant 3*b*, the higher consumption end first reduces its height below the predetermined value, with which it is possible to detect the remaining amount of the solid lubricant becoming below a predetermined value. Therefore, configured in this way, it possible to prevent the surface of the photoreceptor drum 1 from being deteriorated by coming into contact with the lubricant support member 3*d*, which might happen if lack of the lubricant at the higher consumption end of the lubricant applying device 3 is not detected.

Aspect 5

The lubricant supplying device as described in Aspects 2 to 4, wherein the first conductive member and the second conductive member are separated from each other at an early stage of usage of the solid lubricant whereas the first conductive member and the second conductive member come into contact with each other when the remaining amount of the solid lubricant reaches the predetermined value, or a near-end state of the solid lubricant 3*b*, in which the lubricant is supplied to the object to be supplied with the lubricant for a predetermined number of times.

Configured in this way, a downtime of image forming operations can be avoided during an exchange of the lubricant being prepared after the detection because the remaining lubricant can be supplied to the object to be supplied with the lubricant. In the present embodiment, the lubricant support member 3*d* and the electrode member 41 are in a non-conductive state, in which a current does not flow if a voltage is applied between the electrodes, until the lubricant support member 3*d* moves to the position corresponding to the near-end state of the lubricant. This prevents electric power from being consumed every time the detecting operation determining near-end is executed, which reduces electric power consumption.

In addition, the first conductive member and the second conductive member are separated to be in a non-conductive state until the solid lubricant 3*b* reaches the near-end state, then the first conductive member and the second conductive member come into contact with each other when the solid lubricant 3*b* reaches the near-end state. Therefore, electric power is not consumed until the solid lubricant 3*b* reaches the near-end state if the detection of the near-end state is executed. This makes it possible to consume less electric power with this configuration than with a configuration in which the first conductive member and the second conductive member contact each other to be in a conductive state until the solid lubricant 3*b* reaches the near-end state, then the first conductive member and the second conductive member are separated to be in a non-conductive state when the solid lubricant 3*b* reaches the near-end state.

Aspect 6

The lubricant supplying device as described in Aspects 2 to 5, wherein the electrical continuity between the first conductive member and the second conductive member is established only when executing the detection of the remaining amount of the solid lubricant.

Configured in this way, as described in the embodiments, power consumption of the device can be reduced.

Aspect 7

The lubricant supplying device as described in Aspect 6, wherein the remaining amount detecting section executes following operations for the detection of the remaining amount of the solid lubricant, (1) start flowing a current between the first conductive member and the second conductive member, after the operation to supply the lubricant to the object to be supplied with the lubricant stops, and (2) detect the remaining amount of the solid lubricant based on a state of the electrical continuity between the first conductive member and the second conductive member, (3) stop flowing the current between the first conductive member and the second conductive member, after the detection of the remaining amount of the solid lubricant.

Configured in this way, it is possible to establish the electrical continuity between the first conductive member and the second conductive member only when executing the detection of the remaining amount of the solid lubricant.

Aspect 8

The lubricant supplying device as described in Aspects 2 to 7, wherein the remaining amount detecting section detects the near-end state state before the end of the solid lubricant.

Configured in this way, as described in the embodiments, a downtime of image forming operations can be avoided when an exchange of the solid lubricant 3*b* is being prepared after the detection because the remaining lubricant can be supplied to the object to be supplied with the lubricant.

Aspect 9

The lubricant supplying device as described in Aspects 2 to 8, wherein the remaining amount detecting section executes the detection of the remaining amount of the solid lubricant based on a state of the electrical continuity between the first conductive member and the second conductive member as well as a measure for an amount of lubricant supplying operations.

Configured in this way, if the near-end state detection based on the state of the electrical continuity between the first conductive member and the second conductive member fails, it is possible to detect the near-end state by a measure for an amount of lubricant supplying operations. This securely prevents an image forming operation from being executed while the lubricant is lacking.

Aspect 10

The lubricant supplying device as described in Aspect 9, wherein as the measure for an amount of lubricant supplying operations, either one of a distance covered by the supplying member, a distance covered by the object to be supplied with the lubricant, or a driving time of the supplying member, is used.

Configured in this way, the remaining amount of the lubricant can be detected more precisely than using a less precise measure for the amount of lubricant supplying operations, such as the total number of sheets for the detection.

Aspect 11

The lubricant supplying device as described in Aspects 1 to 10, wherein the remaining amount detecting section is disposed at a position downstream in a direction toward which the supplying member rubs the solid lubricant.

Configured in this way, the remaining amount of the solid lubricant 3*b* can be detected at a position downstream in a direction toward which the supplying member moves to rub the solid lubricant.

Aspect 12

An image forming apparatus includes an image bearing member and a lubricant supplying unit to supply lubricant to a surface of the image bearing member, creating an image on the image bearing member, then forming the image on a recording material by transferring the image from the image bearing member, wherein the lubricant supplying device included in Aspects 1 to 11 is included as the lubricant supplying unit.

Configured in this way, it is possible to detect the near-end state of the solid lubricant 3*b* precisely, which prevents an operation from being executed while the lubricant is lacking. Thus, it is possible to prevent the photoreceptor drum 1 from being deteriorated for a long run.

Aspect 13

A process cartridge including an image bearing member and a lubricant supplying unit to supply lubricant to a surface of the image bearing member, configured to be attachable and detachable to an image forming apparatus, wherein the lubricant supplying device included in Aspects 1 to 11 is included as the lubricant supplying unit.

Configured in this way, it is possible to detect the near-end state of the solid lubricant 3*b* precisely, which prevents an image forming operation from being executed while the lubricant is lacking. Thus, a process cartridge can be offered, which prevents the photoreceptor drum 1 from being deteriorated for a long run.

Further, the present invention is not limited to these embodiments and aspects, but various variations and modifications may be made without departing from the scope of the present invention.

The present application is based on Japanese Priority Application No. 2012-063690 filed on Mar. 21, 2012, and Japanese Priority Application No. 2012-219731 filed on Oct. 1, 2012, with the Japanese Patent Office, the entire contents of which are hereby incorporated by reference.

What is claimed is:

1. An image forming apparatus, comprising:

a supplier that rotates to supply a solid lubricant to an object; and a detector to detect, when a rotation of the supplier stops, an amount of the solid lubricant.

2. The image forming apparatus according to claim 1, wherein the rotation of the supplier stops when a motor that drives the supplier is switched from ON to OFF.

3. The image forming apparatus according to claim 1, wherein the rotation of the supplier stops when a motor that drives a photoreceptor is switched from ON to OFF.

4. The image forming apparatus according to claim 1, wherein the detector detects a conductive state of the conductive materials to detect the amount of the lubricant.

5. An image forming apparatus, comprising:

an image bearing member;

a supplier that rotates to supply a lubricant to the image bearing member;

a detector to detect a conductive state of conductive materials when a rotation of the supplier stops; and a controller to determine, based on the conductive state detected by the detector, an amount of the lubricant.

6. The image forming apparatus according to claim 5, wherein the rotation of the supplier stops when a motor that drives the supplier is switched from ON to OFF.

7. The image forming apparatus according to claim 5, wherein the rotation of the supplier stops when a motor that drives a photoreceptor is switched from ON to OFF.

8. The image forming apparatus according to claim 5, wherein the controller determines the amount of the lubricant after the rotation of the supplier has stopped and after a bias has been applied to the conductive materials.

9. The image forming apparatus according to claim 5, wherein the detector repeatedly detects the conductive state of the conductive materials when the rotation of the supplier stops, and the controller determines, when the detector has detected the conductive state more than once, whether the amount of the lubricant is less than or equal to a predetermined amount.

10. The image forming apparatus according to claim 5, wherein during a period after the rotation of the supplier has stopped until a next image forming operation starts, the controller determines the amount of the lubricant while a bias is applied to the conductive materials.

11. The image forming apparatus according to claim 10, wherein when the next image forming operation is requested before completing determining the amount of the lubricant, the controller stops determining the amount of the lubricant and starts the next image forming operation.

12. The image forming apparatus according to claim 5, wherein the conductive materials include a first electrode and a second electrode, and when the lubricant is consumed so that the first electrode and second electrode contact each other, the detector detects the conductive state.

13. An image forming apparatus, comprising:

an image bearing member a supplier that rotates to supply a lubricant to the image bearing member;

a detector to measure a resistance between conductive materials when a rotation of the supplier stops; and a controller to determine, based on the resistance measured by the detector, an amount of the lubricant.

14. The image forming apparatus according to claim 13, wherein the controller determines, when the detector has detected that the resistance being measured is less than or equal to a predetermined value, whether the amount of the lubricant is less than or equal to a predetermined amount.

15. The image forming apparatus according to claim 13, wherein the rotation of the supplier stops when a motor that drives the supplier is switched from ON to OFF.

16. The image forming apparatus according to claim 13, wherein the rotation of the supplier stops when a motor that drives a photoreceptor is switched from ON to OFF.

17. The image forming apparatus according to claim 13, wherein the detector measures the resistance by applying a bias to the conductive materials.

18. The image forming apparatus according to claim 13, wherein the detector repeatedly confirms whether the resistance between the conductive materials is less than or equal to a predetermined value, and the controller determines, when the detector has confirmed more than once that the resistance is less than or equal to the predetermined value, that the amount of the lubricant is less than or equal to a predetermined amount.

19. The image forming apparatus according to claim 13, wherein during a period after the rotation of the supplier has stopped until a next image forming operation starts, the controller determines the amount of the lubricant while a bias is applied to the conductive materials.

20. The image forming apparatus according to claim 13, wherein the conductive materials include a first electrode and a second electrode, and when the lubricant is consumed to make the first electrode and second electrode contact each other, the detector detects the resistance.

* * * * *